US009546031B2

(12) United States Patent
Healy

(10) Patent No.: US 9,546,031 B2
(45) Date of Patent: Jan. 17, 2017

(54) METHOD OF PACKAGING AND PACKAGE OF FIXED-TEMPLE EYEWEAR

(75) Inventor: Andrew Healy, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 1346 days.

(21) Appl. No.: 13/398,448

(22) Filed: Feb. 16, 2012

(65) Prior Publication Data

US 2012/0228162 A1 Sep. 13, 2012

Related U.S. Application Data

(60) Provisional application No. 61/450,061, filed on Mar. 7, 2011.

(51) Int. Cl.

| | |
|---|---|
| ***B65D 71/46*** | (2006.01) |
| ***B65D 77/04*** | (2006.01) |
| ***B65D 85/38*** | (2006.01) |
| *A45C 11/04* | (2006.01) |

(52) U.S. Cl.

CPC ..... *B65D 71/46* (2013.01); *B65D 77/0413* (2013.01); *B65D 85/38* (2013.01); *A45C 11/04* (2013.01)

(58) Field of Classification Search

CPC ..... B65D 71/46; B65D 77/0413; B65D 85/38; B45C 11/04; B65B 11/58; B65B 25/026; B65B 35/50; B65B 5/06

USPC ..... 53/449, 447

See application file for complete search history.

(56) References Cited

U.S. PATENT DOCUMENTS

| | | | | |
|---|---|---|---|---|
| 3,872,650 A * | 3/1975 | Vickers | B65B 11/004 53/207 |
| 5,678,389 A * | 10/1997 | Henry | B65D 71/0096 53/207 |
| 5,697,495 A * | 12/1997 | Abrams | B65B 25/008 134/901 |
| 6,772,878 B1 * | 8/2004 | Liebers | A45C 11/04 206/458 |
| 7,490,717 B2 * | 2/2009 | Chao | A47F 7/021 206/6 |
| 7,748,534 B2 * | 7/2010 | Jeannin | B65D 75/327 206/528 |
| 7,775,387 B2 | 8/2010 | Lipton | |

(Continued)

FOREIGN PATENT DOCUMENTS

| | | |
|---|---|---|
| DE | 19863630787 | 3/1988 |
| DE | 202004019486 | 5/2006 |

(Continued)

*Primary Examiner* — Sameh Tawfik

(57) ABSTRACT

A novel method of packaging fixed-temple eyewear includes arranging a first plurality of pairs of fixed-temple eyewear in a first arrangement with the lenses of the eyewear lying substantially in the same plane. The right temples of the eyewear are aligned along a first line and the left temples of the eyewear are aligned along a second line. The first plurality of pairs of eyewear is held in the first arrangement with a first portion of packaging material. Second and third pluralities of fixed temple eyewear are similarly arranged in second and third arrangements, respectively. The first, second, and third arrangements of fixed-temple eyewear are engaged with one another in a space saving relationship and packaged. Packages of fixed-temple eyewear are also disclosed.

23 Claims, 22 Drawing Sheets

(56) References Cited

U.S. PATENT DOCUMENTS 8,322,532 B2 * 12/2012 Schafer ..... B65D 25/10
206/454
8,746,558 B2 * 6/2014 Healy ..... G06Q 10/087
235/381

FOREIGN PATENT DOCUMENTS

| | | |
|---|---|---|
| JP | 2003312739 | 11/2003 |
| WO | 2011/115917 | 9/2011 |

* cited by examiner

METHOD OF PACKAGING AND PACKAGE OF FIXED-TEMPLE EYEWEAR

CROSS REFERENCE TO RELATED APPLICATIONS

This Application claims the benefit of priority to related, Provisional U.S. Patent Application No. 61/450,061 filed on 7 Mar. 2011 entitled "Method of Packaging and Package of Fixed-Temple Eyewear" by Andrew Healy hereby incorporated by reference in its entirety.

BACKGROUND OF THE INVENTION

Field of the Invention

This invention relates generally to packaging eyewear, and more particularly to packaging multiple pairs of fixed-temple eyewear.

Description of the Background Art

FIG. 1 is a perspective view of a pair of fixed-temple eyewear 100. Eyewear 100 includes a right lens 102 a left lens 104 mounted in a frame 106. Eyewear 100 further includes a right temple 108 extending from the right side of frame 106 and a left temple 110 extending from the left side of frame 106.

In a vast majority of personal eyewear, the temples are connected to the frames by a hinge, so that the temples can be folded in toward the lenses. The hinged temples make the eyewear easier to store and package for shipping. In general, folded eyewear can be packed more densely than unfolded eyewear.

However, in certain situations it is preferable for the temples to be fixed in position with respect to the frames. For example, fixed-temple 3D glasses are more difficult for theater patrons to conceal and are, therefore, less likely to be stolen. As another example, fixed-temple eyewear requires fewer parts and, therefore, can be less expensive to manufacture.

Eyewear 100 is an example of fixed-temple eyewear. In particular, temples 108 and 110 are rigidly fixed in position with respect to frame 106. Indeed, in the example eyewear 100 frame 106 and temples 108 and 110 are formed as a unitary structure of rigid plastic.

FIG. 2 shows an example of a prior art packaging method for fixed-temple eyewear 100. According to this prior art method, several pairs of the fixed-temple glasses 100 are arranged in stacked trays 202. In this arrangement, the lenses lie in planes that are substantially perpendicular to the plane of the arrangement (i.e., the plane of the tray). The temples of the eyewear lie generally in the plane of the tray in alternating orientations, so that a temple of one pair of eyewear lies between the temples of another pair of eyewear.

Although the packaging arrangement of FIG. 2 is capable of shipping eyewear without damage, the arrangement, with twelve regular adult size glasses per tray, results in a product density of only about 24.6 pairs of eyewear per cubic foot. This low product density results in increased shipping costs and requires a significant amount of storage space. In addition, the trays themselves must be formed to receive the eyewear and are, therefore, relatively expensive to produce. Furthermore, the weight of the trays adds to the overall shipping weight.

What is needed, therefore, is a packaging system that achieves a higher product density than known packaging systems for fixed-temple eyewear. What is also needed is a packaging system that results in a significantly lower shipping weight for fixed-temple eyewear. What is also needed is a packaging system that requires less storage space than known packaging systems for fixed-temple eyewear. What is also needed is a packaging system that uses less expensive packaging materials than known packaging systems for fixed-temple eyewear.

SUMMARY

The present invention overcomes the problems associated with the prior art by providing an efficient system and method for packaging fixed-temple eyewear. The invention facilitates packaging fixed-temple eyewear with a product density of at least 40, 50, and even in excess of 53 pairs of eyewear per cubic foot.

An example method for packaging fixed-temple eyewear is disclosed. Each pair of fixed-temple includes two lenses and two temple pieces fixed in position with respect to the lenses. The method includes providing a first plurality of pairs of the fixed-temple eyewear and providing a first portion of packaging material. The method additionally includes arranging the first plurality of pairs of fixed-temple eyewear in a first arrangement. In the first arrangement, the lenses lie substantially in a first plane, a first one of the temples of each of the pairs of fixed-temple eyewear are aligned along a first line, and a second one of the temples of each of the pairs of fixed-temple eye-wear are aligned along a second line. The method additionally includes fixing the plurality of pairs of fixed-temple eyewear in the first arrangement with the portion of the packaging material. Optionally, the example methods also include placing a protective sleeve around each of the pairs of fixed-temple eyewear.

The example method further includes providing a second plurality of pairs of the fixed-temple eyewear, providing a second portion of packaging material, arranging the second plurality of pairs of fixed-temple eyewear in a second arrangement, and fixing the second plurality of pairs of fixed-temple eyewear in the second arrangement with the second portion of the packaging material. In the second arrangement of fixed-temple eyewear, the lenses lie substantially in a second plane, a first one of the temples of each of the pairs of fixed-temple eyewear of the second plurality of fixed temple eyewear are aligned along a first line, and a second one of the temples of each of the pairs of fixed-temple eye-wear of the second plurality of fixed-temple eyewear are aligned along a second line. The example method further includes engaging the first arrangement of the plurality of pairs of the fixed-temple eyewear with the second arrangement of the second plurality of pairs of the fixed-temple eyewear.

The example method further includes providing a third plurality of pairs of the fixed-temple eyewear, providing a third portion of packaging material, arranging the third plurality of pairs of fixed-temple eyewear in a third arrangement, and fixing the third plurality of pairs of fixed-temple eyewear in the third arrangement with the third portion of the packaging material. In the third arrangement, the lenses of the eyewear lie substantially in a third plane, a first one of the temples of each of the pairs of fixed-temple eyewear are aligned along a first line, and a second one of the temples of each of the pairs of fixed-temple eye-wear are aligned along a second. The example method further includes engaging the third arrangement of the third plurality of pairs of fixed-temple eyewear with the first arrangement of the first plurality of pairs of the fixed-temple eyewear and the second arrangement of the second plurality of pairs of the fixed-temple eyewear to form an assembly of the fixed-temple eyewear.

In a particular example method, the step of engaging the first arrangement of the first plurality of pairs of the fixed-temple eyewear with the second arrangement of the second plurality of pairs of the fixed-temple eyewear includes positioning the second arrangement of fixed-temple eyewear within the temples of the first arrangement of the first plurality of pairs of fixed-temple eyewear, orienting the second arrangement of fixed-temple eyewear with the first line of the second arrangement being substantially perpendicular to the first line of the first arrangement, and positioning the second portion of packaging material on the first portion of packaging material. The step of engaging the third arrangement of fixed-temple eyewear with the first arrangement of fixed-temple eyewear and the second arrangement of fixed-temple eyewear includes positioning the third arrangement of fixed-temple eyewear with the first line of the third arrangement substantially parallel to the first line of the first arrangement and substantially perpendicular to the first line of the second arrangement, and with the temples of the third plurality of eyewear extending in a direction opposite to the temples of the first plurality of eyewear and the temples of the second plurality of eyewear. The method also includes interleaving the temples of the eyewear of the third arrangement with the temples of the eyewear of the first arrangement.

The example method additionally includes placing the first arrangement of fixed temple eye-wear, the second arrangement of fixed temple eye-wear, and the third arrangement of fixed temple eye-wear in a substantially rectangular parallelepiped container (e.g., a corrugated cardboard box). Optionally, the step of placing the first arrangement, the second arrangement, and the third arrangement in the container occurs after the step of engaging the third arrangement of pairs of fixed-temple eyewear with the first arrangement of pairs of the fixed-temple eyewear and the second arrangement of pairs of the fixed-temple eyewear.

An alternate method includes positioning additional iterations of the second arrangement of the second plurality of pairs of fixed-temple eyewear within the temples of the first plurality of pairs of the fixed-temple eyewear of the first arrangement of the first plurality of pairs of fixed-temple eyewear. The alternate method additionally includes orienting the additional iterations of the second arrangement of the second plurality of fixed-temple eyewear with the first line of the additional iterations of second arrangement being substantially perpendicular to the first line of the first arrangement. The alternate method also includes positioning the second portions of packaging material of the additional iterations of the second arrangement on the first portion of packaging material of the first arrangement.

In one particular method, the first plurality of pairs of fixed-temple eyewear includes a different number of pairs of fixed-temple eyewear than the second plurality of pairs of fixed temple eyewear, and the first plurality of pairs of the fixed-temple eyewear includes the same number of pairs of fixed-temple eyewear as the third plurality of pairs of fixed temple eyewear. In certain preferred methods, the number of pairs of the fixed-temple eyewear in the first plurality of the pairs of fixed-temple eyewear is an integer multiple of four, and the number of pairs of the fixed-temple eyewear in the second plurality of pairs of fixed-temple eyewear is three. Optionally, the first plurality of pairs of the fixed-temple eyewear includes a different number of pairs of fixed-temple eyewear than the third plurality of pairs of fixed temple eyewear. As another option, the eyewear of the first plurality of the fixed-temple eyewear can be of a different size than the eyewear of the second plurality of the fixed-temple eyewear (e.g., adult and child).

Some particular methods also include repeating the steps arranging, fixing and engaging the first, second and third pluralities of fixed-temple eyewear to form additional assemblies of the fixed-temple eyewear and placing a plurality of the assemblies in a single rectangular parallelepiped container. Optionally, these methods additionally include placing dividers between the assemblies in the single rectangular parallelepiped container.

Optional methods for including individual pairs of fixed-temple eyewear are also disclosed. For example, the example methods can additionally include providing at least one additional pair of fixed-temple eyewear and placing the additional pair of fixed-temple eyewear loose within a space defined by the temples of the fixed-temple eyewear of the first plurality of fixed-temple eyewear. As another example, the example methods can additionally include providing at least one additional pair of fixed-temple eyewear and engaging the additional pair of fixed-temple eyewear with the first arrangement of the fixed-temple eyewear by inserting the temples of the additional pair of fixed-temple eyewear between the temples of the fixed-temple eyewear of the first arrangement with the temples of the additional pair of fixed-temple eyewear oriented substantially perpendicular to the temples of the fixed-temple eyewear of the first arrangement.

Example methods are also disclosed in conjunction with particular examples of packaging materials. In one particular method, the first portion of packaging material includes a first section and a second section and the step of fixing the plurality of pairs of fixed-temple eyewear in the first arrangement includes positioning the first section of the packaging material on a front side of lenses of each pair of the first plurality of the fixed-temple eyewear, positioning the second section of the packaging material on a rear side of the lenses of each pair of the first plurality of the fixed-temple eyewear, and fixing the positions of the first section and the second section of the first portion of packaging material with respect to one another. In the particular method, the first portion of packaging material includes an intermediate section flexibly coupling the first section to the second section, the first section includes an engaging feature, the second section includes a complementary engaging feature, and the step of fixing the positions of the first section and the second section of the first portion of packaging material includes engaging the engaging feature of the first section with the engaging feature of the second section.

Additionally, in the particular example method, the second section of the packaging material includes a first edge, a second edge opposite the first edge, a first plurality protrusions extending from the first edge, and a second plurality of protrusions extending from the second edge. The step of positioning the second section of the packaging material on a rear side of the lenses of each pair of the first plurality of the fixed-temple eyewear includes disposing respective ones of the protrusions between respective pairs of the fixed-temple eyewear of the first plurality of the fixed temple eyewear. The second section of the first portion of the packaging material includes at least one preformed fold disposed between and extending along substantially the same direction as the first and second edges. In addition, the intermediate section of the first portion of packaging material has a width that is narrower than the second section of the first portion of packaging material, the at least one preformed fold includes a first fold and a second fold, and the first fold is spaced apart from the second fold by a distance greater than or equal to the width of the intermediate section of the packaging material.

Packages of eyewear are also disclosed. An example package of fixed-temple eyewear includes a first plurality of pairs of the fixed-temple eyewear, each pair having two lenses and two temple pieces fixed in position with respect to the lenses, and a first portion of packaging material fixing the first plurality of pairs of fixed-temple eyewear in a first arrangement. In the first arrangement, the lenses lie substantially in a same (first) plane, a first one of the temples of each of the pairs of fixed-temple eyewear of the first plurality of fixed-temple eyewear are aligned along a first line, and a second one of the temples of each of the pairs of fixed-temple eye-wear of the first plurality of fixed temple eyewear are aligned along a second line.

The example package of fixed-temple eyewear also includes a second plurality of pairs of the fixed-temple eyewear and a second portion of packaging material fixing the second plurality of pairs of fixed-temple eyewear in a second arrangement. In the second arrangement the lenses lie substantially in a same plane, a first one of the temples of each of the pairs of fixed-temple eyewear of the second plurality of fixed temple eyewear are aligned along a first line, and a second one of the temples of each of the pairs of fixed-temple eye-wear of the second plurality of fixed-temple eyewear are aligned along a second line. The first arrangement of the plurality of pairs of the fixed-temple eyewear is engaged with the second arrangement of the second plurality of pairs of the fixed-temple eyewear.

The example package of fixed-temple eyewear also includes a third plurality of pairs of the fixed-temple eyewear and a third portion of packaging material fixing the third plurality of pairs of fixed-temple eyewear in a third arrangement, wherein the lenses lie substantially in a same plane, a first one of the temples of each of the pairs of fixed-temple eyewear of the third plurality of the fixed-temple eyewear are aligned along a first line, and a second one of the temples of each of the pairs of fixed-temple eye-wear of the third plurality of the fixed-temple eyewear are aligned along a second line. The third arrangement of the third plurality of pairs of fixed-temple eyewear are engaged with the first arrangement of the first plurality of pairs of the fixed-temple eyewear and the second arrangement of the second plurality of pairs of the fixed-temple eyewear to form an assembly of the fixed-temple eyewear.

In the particular example package of fixed-temple eyewear, the second arrangement of the second plurality of pairs of the fixed-temple eyewear is disposed within a space defined by the temples of the first plurality of pairs of fixed-temple eyewear of the first arrangement. The second arrangement of the second plurality of fixed-temple eyewear is oriented with the first line of the second arrangement being substantially perpendicular to the first line of the first arrangement and the second portion of packaging material is positioned on the first portion of packaging material. The third arrangement of the third plurality of pairs of the fixed-temple eyewear is disposed with the first line of the third arrangement substantially parallel to the first line of the first line of the first arrangement and substantially perpendicular to the first line of the second arrangement. The temples of the third plurality of eyewear extend in a direction (e.g., downward) opposite to the temples of the first plurality of eyewear and the temples of the second plurality of eyewear (e.g., upward). The temples of the eyewear of the third arrangement are interleaved with the temples of the eyewear of the first arrangement.

The example package of fixed-temple eyewear further includes a substantially rectangular, parallelepiped container enclosing the first arrangement of the first plurality of pairs of the fixed temple eye-wear, the second arrangement of the second plurality of pairs of the fixed temple eye-wear, and the third arrangement of the third plurality of pairs of the fixed temple eye-wear.

An alternate example package of fixed-temple eyewear additionally includes additional iterations of the second arrangement of the second plurality of pairs of fixed-temple eyewear positioned within a space defined by the temples of the first plurality of pairs of the fixed-temple eyewear of the first arrangement of the first plurality of pairs of fixed-temple eyewear the additional iterations of the second arrangement of the second plurality of fixed-temple eyewear are oriented with the first line of the additional iterations of second arrangement being substantially perpendicular to the first line of the first arrangement. The second portions of packaging material of the additional iterations of the second arrangement are positioned on the first portion of packaging material of the first arrangement.

Optionally, the first plurality of pairs of fixed-temple eyewear includes a different number of pairs of the fixed-temple eyewear than the second plurality of pairs of fixed temple eyewear, and the first plurality of pairs of the fixed-temple eyewear includes the same number of pairs of the fixed-temple eyewear as the third plurality of pairs of fixed temple eyewear. For the example eyewear, space is efficiently used when the number of pairs of the fixed-temple eyewear in the first plurality of pairs of the fixed-temple eyewear is an integer multiple of four and the number of pairs of the fixed-temple eyewear in the second plurality of the pairs of fixed-temple eyewear is three. Optionally, the first plurality of pairs of the fixed-temple eyewear includes a different number of pairs of fixed-temple eyewear than the third plurality of pairs of fixed temple eyewear.

An example package of fixed-temple eyewear includes additional assemblies of the fixed-temple eyewear. A plurality of the assemblies are disposed in a single rectangular parallelepiped container. Dividers are disposed between the assemblies in the single rectangular parallelepiped container.

Optionally, the eyewear of the first plurality of the fixed-temple eyewear is of a different size than the eyewear of the second plurality of the fixed-temple eyewear. As another option, the package of fixed-temple eyewear of Claim 28 additionally includes a plurality of protective sleeves. Each sleeve is disposed around a respective one of the pairs of fixed-temple eyewear.

As yet another option, the package of fixed-temple eyewear can include one or more additional, single pairs of fixed-temple eyewear. For example, the package of fixed-temple eyewear can include at least one additional pair of fixed-temple eyewear loosely disposed within a space defined by the temples of the fixed-temple eyewear of the first plurality of fixed-temple eyewear. As another option, the example package of fixed-temple eyewear can include at least one additional pair of fixed-temple eyewear engaged with the first arrangement of the fixed-temple eyewear by the temples of the additional pair of fixed-temple eyewear being disposed between the temples of the fixed-temple eyewear of the first arrangement. The temples of the additional pair of fixed-temple eyewear are oriented substantially perpendicular to the temples of the fixed-temple eyewear of the first arrangement.

The example packages of fixed-temple eyewear have an eyewear density of at least 40, 50, or even more than 53 pairs of eyewear per cubic foot.

In the example packages of fixed-temple eyewear, the first portion of packaging material includes a first section and a second section The first section of the packaging material is disposed on a front side of the lenses of each pair of the first plurality of the fixed-temple eyewear. The second section of the packaging material is disposed on a rear side of the lenses of each pair of the first plurality of the fixed-temple eyewear and the first section and the second section of the first portion of packaging material are fixed with respect to one another.

More particularly, in the example package of fixed-temple eyewear the first portion of packaging material includes an intermediate section flexibly coupling the first section to the second section, the first section includes an engaging feature, and the second section includes a complementary engaging feature adapted to engage the engaging feature of the first section. The second section includes a first edge, a second edge opposite the first edge, a first plurality protrusions extending from the first edge, and a second plurality of protrusions extending from the second edge. Respective ones of the protrusions are disposed between respective pairs of the fixed-temple eyewear of the first plurality of the fixed temple eyewear. Optionally, the second section of the first portion of the packaging material includes at least one preformed fold disposed between and extending along substantially the same direction as the first and second edges.

In the example package, the intermediate section of the first portion of packaging material has a width that is narrower than the second section of the first portion of packaging material. The at least one preformed fold includes a first fold and a second fold and the first fold is spaced apart from the second fold by a distance greater than or equal to the width of the intermediate section of the packaging material.

Several means for fixing a plurality of pairs of fixed-temple eyewear in an arrangement, wherein the lenses lie substantially in a same plane, a first one of the temples of each of the pairs of fixed-temple eyewear of the first plurality of fixed-temple eyewear are aligned along a first line, and a second one of the temples of each of the pairs of fixed-temple eye-wear of the first plurality of fixed temple eyewear are aligned along a second line, are also disclosed.

BRIEF DESCRIPTION OF THE DRAWINGS

The present invention is described with reference to the following drawings, wherein like reference numbers denote substantially similar elements.

DETAILED DESCRIPTION

The present invention overcomes the problems associated with the prior art, by providing an efficient system and method for packaging fixed-temple eyewear. In the following description, numerous specific details are set forth (e.g., numbers of pairs of eyewear fixed in example arrangements) in order to provide a thorough understanding of the invention. Those skilled in the art will recognize, however, that the invention may be practiced apart from these specific details. In other instances, details of well known packaging practices (e.g., taping, labeling, etc.) and equipment have been omitted, so as not to unnecessarily obscure the present invention.

In an example embodiment described herein, the eyewear packaging achieves a product density of approximately 53.5 pairs of eyewear per cubic foot, which results in an improved environmental footprint as compared to prior art packaging. In addition to using less packaging, the increased product density uses less transportation resources and, therefore, causes less transportation related pollution.

Moreover, the vertical orientation shown in the described examples provides the unexpected advantage of improved RFID scanning for manufacturers and freight forwarders. The vertical orientation increases the distance between the antennae and improves signal strength to embedded eyewear RFID tags.

Figure 1:
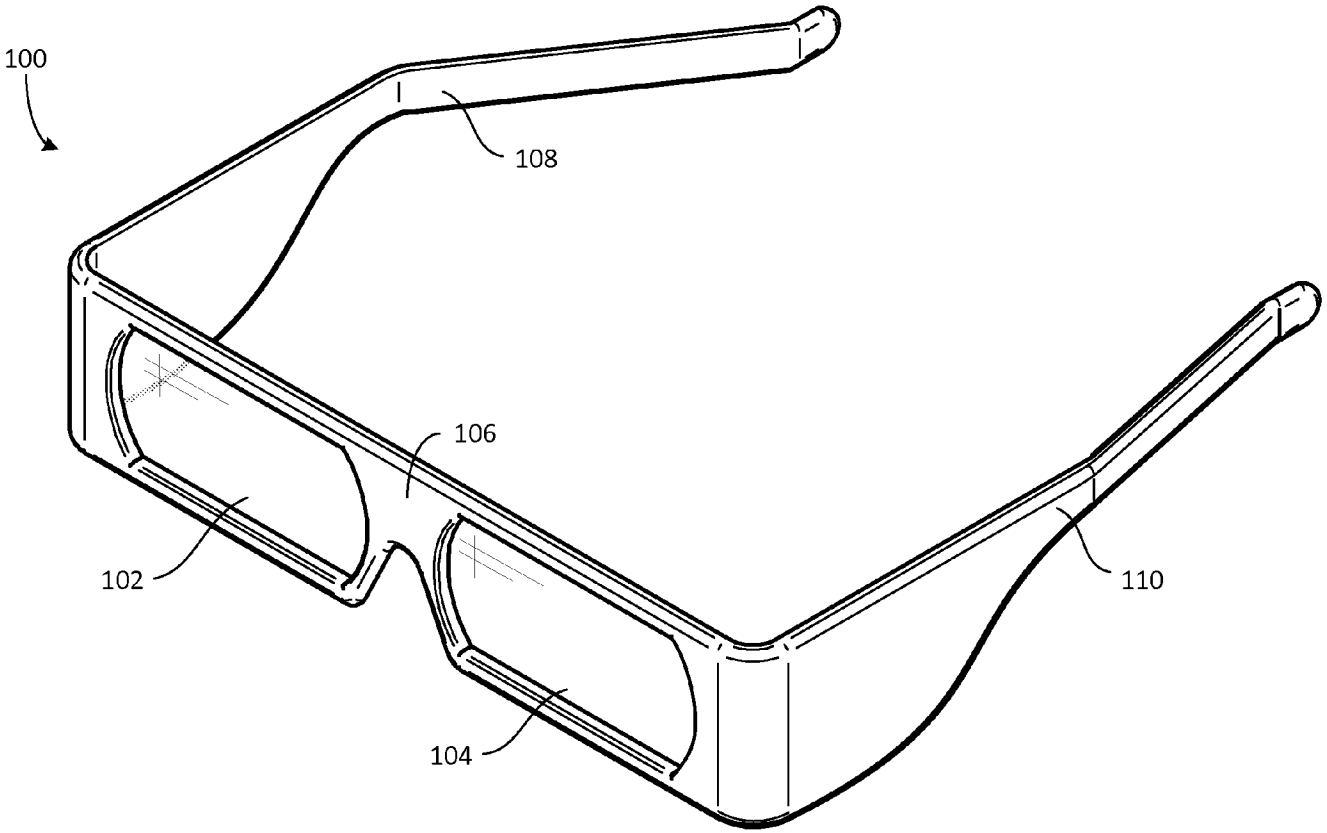
FIG. 1 (Prior Art)
FIG. 1 is a perspective view of a pair of fixed-temple eyewear.
Figure 2:
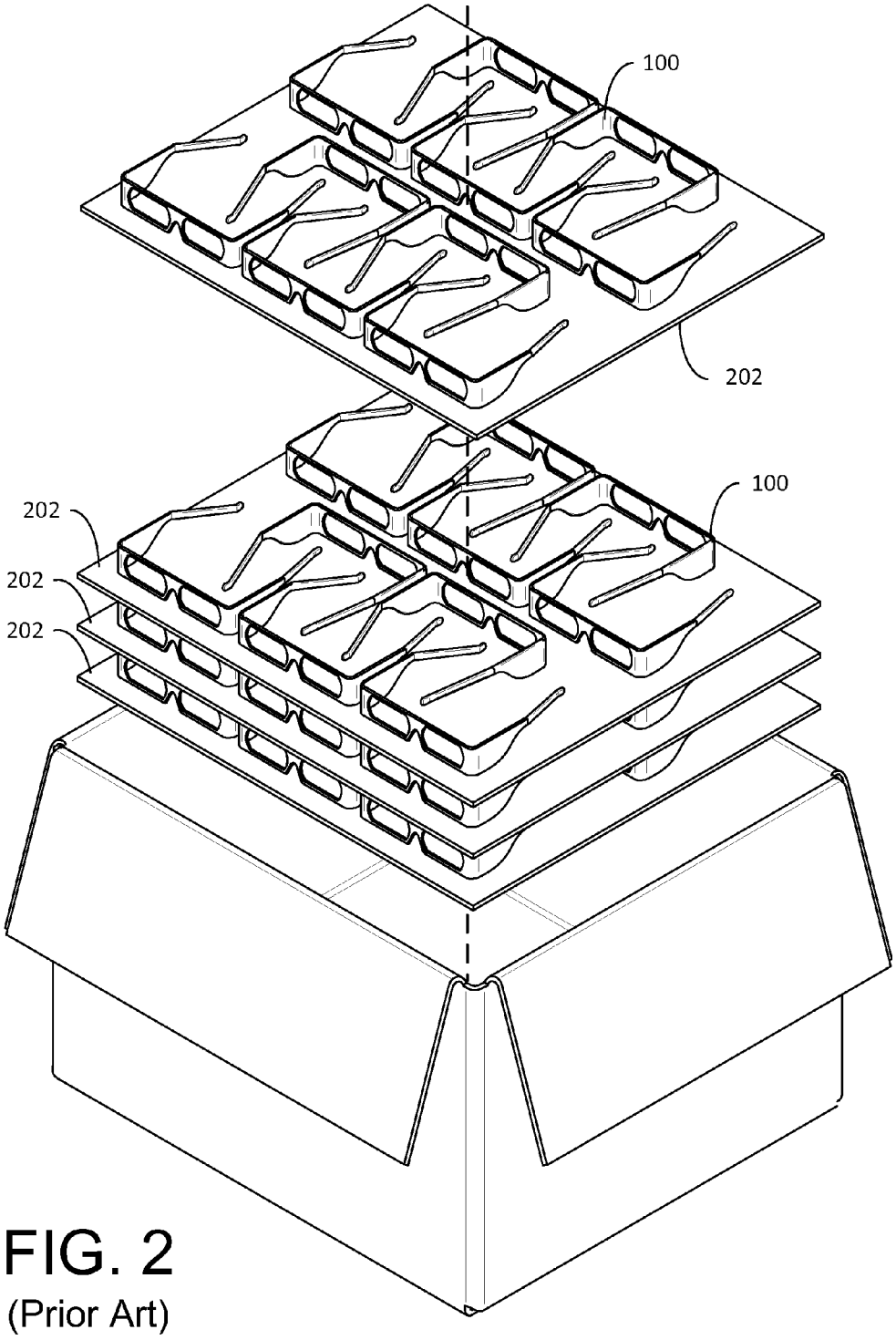
FIG. 2 (Prior Art)
FIG. 2 is a perspective view of a prior art packaging method for fixed-temple eyewear.
Figure 3:
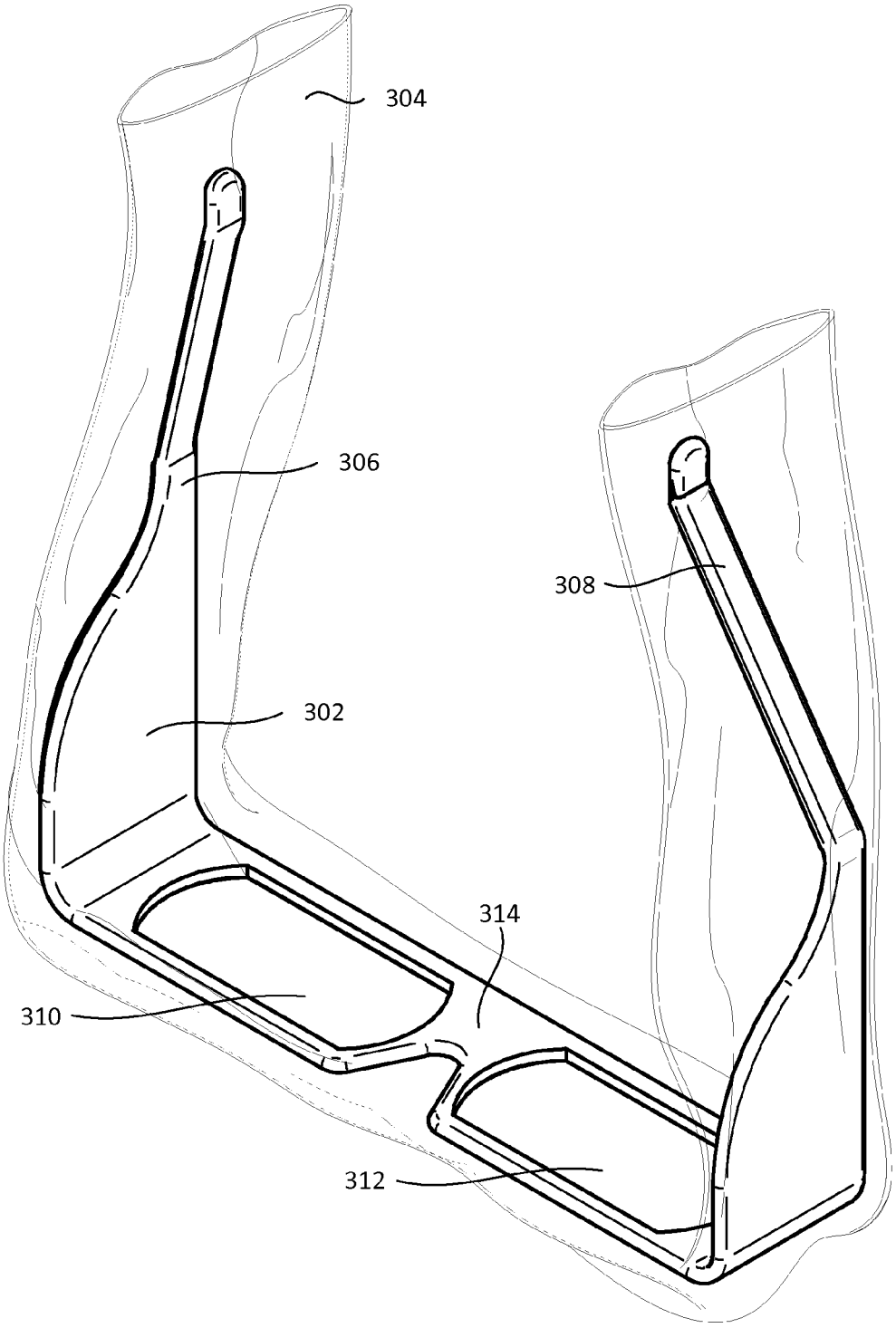
FIG. 3 is a perspective view of a pair of fixed-temple eyewear in a protective sleeve.

FIG. 3 shows a pair of fixed-temple eyewear 302 disposed within a protective pliable sleeve 304. Eyewear 302 includes a left temple 306, a right temple 308, a left lens 310, and a right lens 312, all held together by a frame 314. Because eyewear 302 is a pair of fixed-temple eyewear, temples 306 and 308 are in a permanent, fixed position with respect to frame 314.

Sleeve 304 protects eyewear 302 from scratches and abrasions that can result from vibrations encountered during shipping. Such vibrations can cause eyewear 302 to rub against other packaging material (e.g., cardboard containers), causing visible defects. Sleeve 304 eliminates, or at least significantly reduces, such defects. In this example embodiment, protective sleeve 304 is made of plastic. However, any suitable material that reduces friction between eyewear 302 and other packaging material or other eyewear can be used to fabricate protective sleeve 304.

While protective sleeve 304 is considered to provide an important advantage in combination with certain packaging materials, protective sleeve 302 is not considered to be an essential element of the present invention. Rather, protective sleeve 302 is considered to be an optional feature.

Although it is possible in some circumstances to omit protective sleeve 304, for most applications each pair of fixed-temple eyewear 302 will be placed in a separate protective sleeve 304. Nevertheless, protective sleeves 304 are not shown in the subsequent drawings. Protective sleeves 304 are omitted from the subsequent drawings so as not to unnecessarily obscure the other details of the drawings. The omission of protective sleeves 304 from these drawings is not intended to suggest that sleeves 304 do not provide an important advantage.

Figure 4:
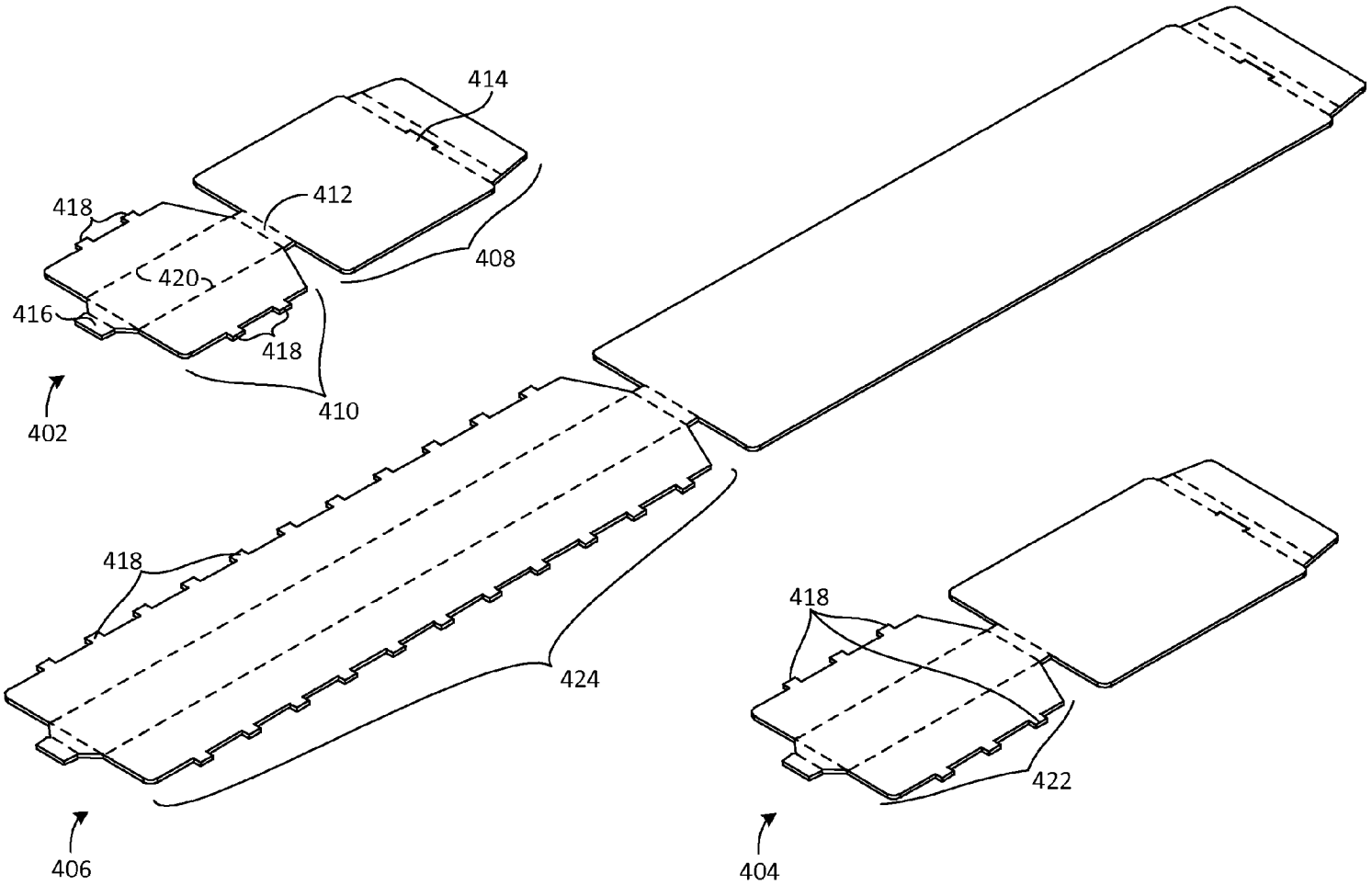
FIG. 4 is a perspective view of packaging material for packaging fixed-temple eyewear according to on aspect of the present invention.

FIG. 4 is a perspective view of three separate portions of packaging material 402, 404, and 406. Packaging material portions 402, 404, and 406 are similar, except that each holds a different number of pairs of eyewear, which will become clear as the description of the example embodiment proceeds. In particular, packaging material portion 402 holds 3 pairs of eyewear, packaging material portion 404 holds 4 pairs of eyewear, and packaging material portion 406 holds 12 pairs of eyewear. The features of packaging material portions 402, 404, and 406 will first be described without showing pairs of eyewear 302 in FIG. 4. The relationship between packaging material portions 402, 404, and 406 and pairs of eyewear 302 will be made clear in the description of subsequent drawings.

Packaging material portion 402 includes a first section 408 and a second section 410 flexibly coupled by an intermediate section 412. Preformed folds separate intermediate section 412 from first section 408 and second section 410 and facilitate folding second section 410 over first section 408. First section 408 includes an engaging feature 414 (e.g., a slot) that is adapted to engage a complementary engaging feature 416 (e.g., a tab) on second section 410. When engaged, engaging feature 414 and complementary engaging feature 416 hold packaging material portion 402 in a closed position.

Second section 410 also includes a plurality of protrusions 418 extending from opposite edges of second section 410. Protrusions 418 function to separate and/or position respective pairs of eyewear 302 (not shown in FIG. 4), as will be discussed in greater detail with reference to the subsequent drawings. In addition, second section 410 includes two preformed folds 420 disposed between and extending along substantially the same direction as the edges of second section 410 that define protrusions 418. Folding second section 410 along folds 420 facilitates the positioning of second section 410 between the temples of a plurality (3) of pairs of eyewear 302 (not shown in FIG. 4) that will be fixed in an arrangement by packaging material portion 402. The distance between folds 420 is greater than or equal to the width of intermediate section 412, so that second section 410 can be folded longitudinally without folding first section 408.

Packaging material portions 404 and 406 are substantially similar to packaging material portion 402, except that the length of packaging material portions 404 and 406 are designed to hold more pairs of eyewear 302. In particular, packaging material portion 404 is slightly longer and includes one additional pair of protrusions on the edges of second section 422. Therefore, packaging material portion 404 can fix one additional pair of eyewear (4 total) in an arrangement. The second section 424 of packaging material portion 406 defines 11 protrusions along each edge. Therefore, packaging material portion 406 can fix 12 pairs of eyewear in an arrangement.

The spacing between adjacent protrusions 418 is determined by the height of the eyewear 302 and is the same for all three packaging material portions 402, 404, and 406. Similarly, the widths of packaging material portions 402, 404, and 406 are all the same and are primarily determined by the width of eyewear 302.

In general, a packaging material portion can be sized to fix any number of pairs of fixed-temple eyewear in an arrangement. However, for reasons that will be subsequently explained with reference to FIGS. 16-18, packaging material portions that hold numbers of pairs of eyewear that are an integer multiples of 4 (e.g., 4 pairs, 8, pairs, 12 pairs, . . . ) are preferred.

In the example embodiment, packaging material portions 402, 404, and 406 are all made of corrugated cardboard. However, packaging material portions 402, 404, and 406 can be made of any suitable material including, but not limited to, foam and/or plastic.

Figure 5:
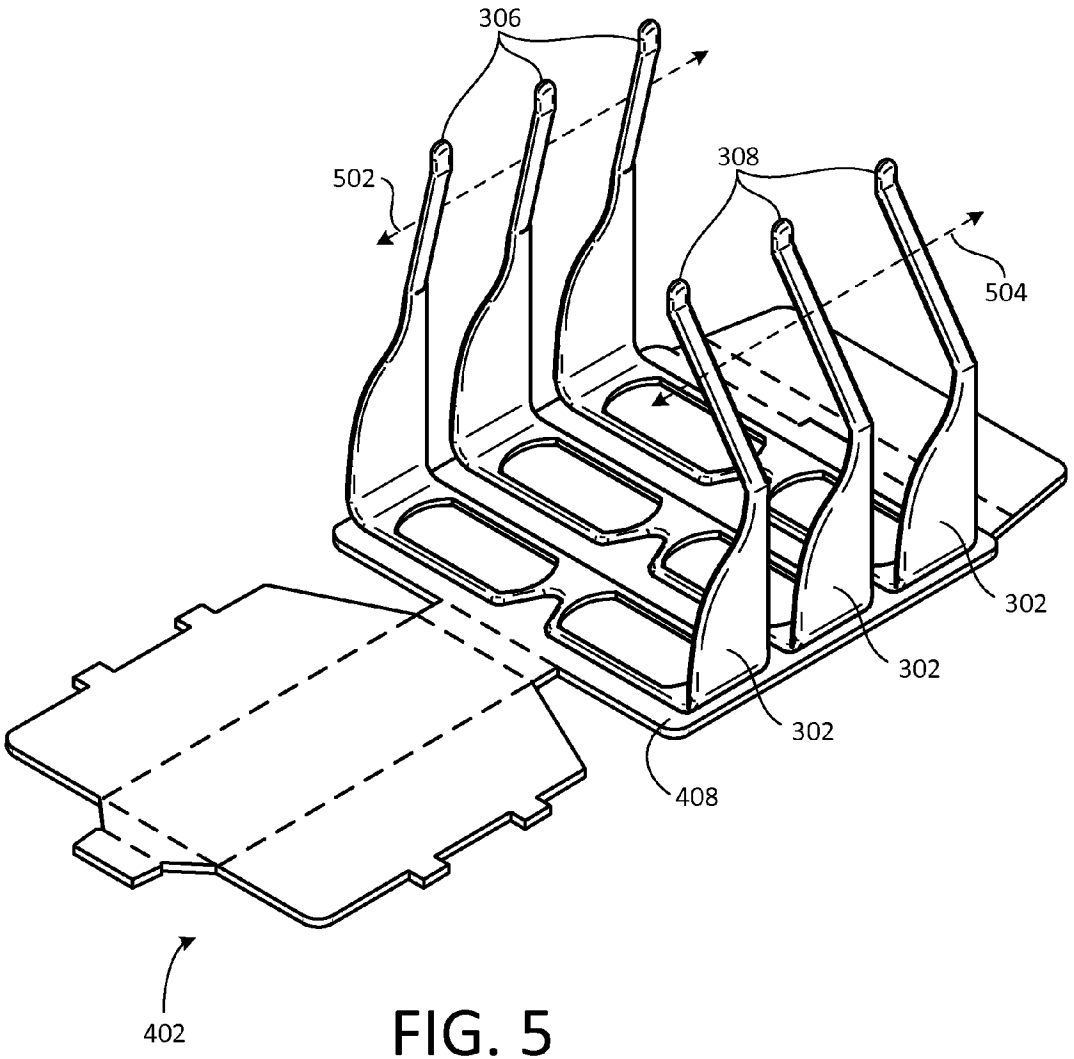
FIG. 5 is a perspective view of an arrangement of a plurality of pairs of fixed-temple eyewear on a portion of the packaging material of FIG. 4.

FIG. 5 shows a plurality (3) of fixed-temple eyewear arranged on a portion of packaging material 402. Eyewear 302 are arranged with their lenses lying substantially in a single plane, with the front surfaces of the lenses resting on the surface of first section 408 of packaging material portion 402. The left temples 306 of each pair of eyewear 320 are aligned along a first line 502, and the right temples 308 of each pair of eyewear 302 are aligned along a second line 504. Each pair of eyewear 302 is slightly spaced apart from the adjacent pairs of eyewear 302.

Figure 6:
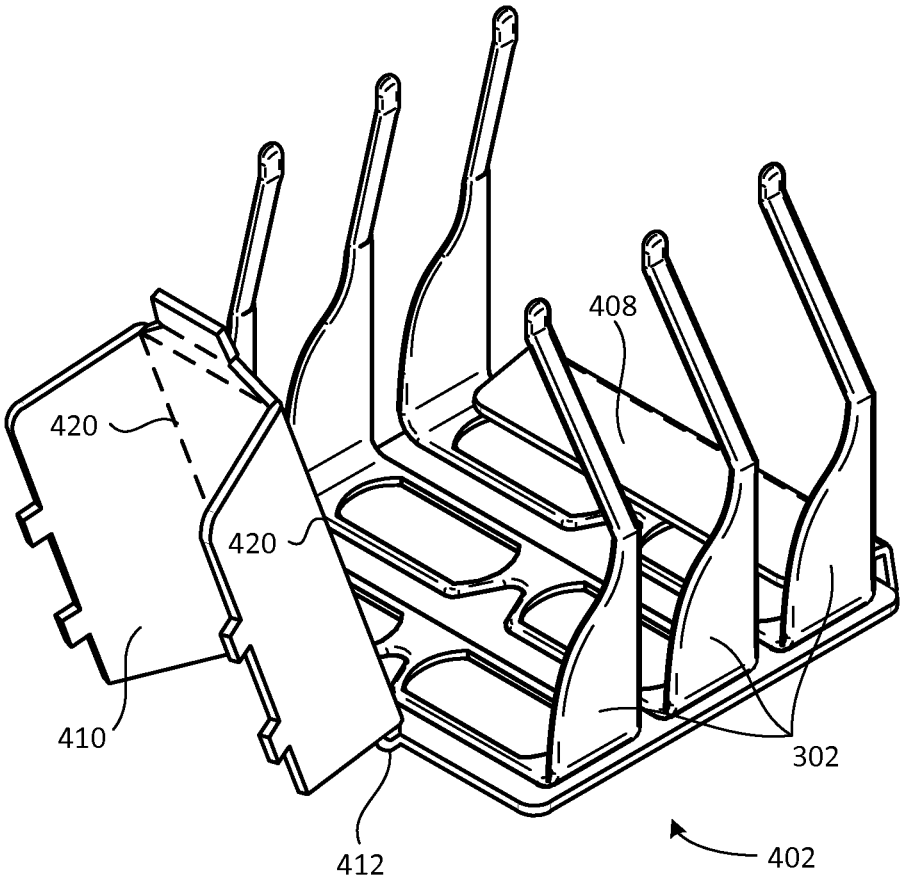
FIG. 6 is a perspective view of the arrangement of eyewear of FIG. 5 with the portion of packaging material in a partially closed position.

FIG. 6 shows packaging material portion 402 in a partially closed position. In particular, second section 410 is folded upward, as facilitated by the preformed folds in intermediate section 412. In addition, the lateral edges of second section 410 are folded back, as facilitated by preformed folds 420. The distal end of first section 408 is also folded up over the pair of eyewear 302 closest to the distal end of first section 408.

Figure 7:
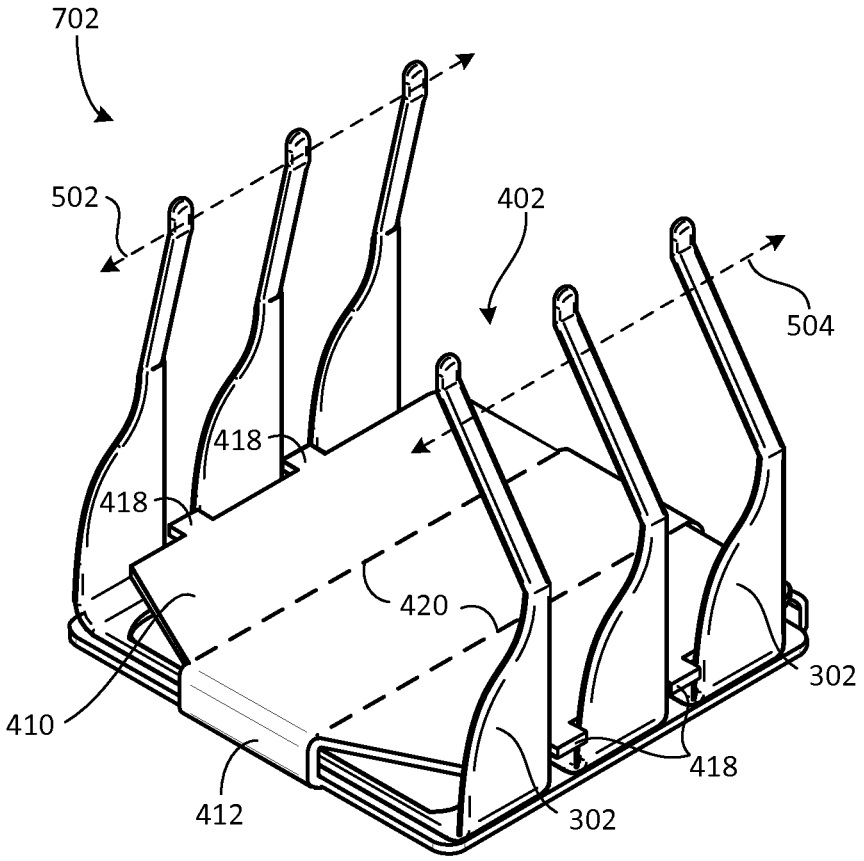
FIG. 7 is a perspective view of the arrangement of FIG. 5 with the portion of packaging material in a closed position fixing the eyewear in the arrangement.

FIG. 7 shows the portion of packaging material 402 in a fully closed position, thereby fixing the plurality of pairs of fixed-temple eyewear 302 in the desired arrangement. Although not visible in FIG. 7, engaging feature 414 is engaged with complementary engaging feature 416, so that packaging material 402 is held in the closed position. Protrusions 418 extending from the lateral edges of second section 410 are disposed between adjacent pairs of eyewear 302, thereby maintaining the desired spacing between adjacent pairs of eyewear 302. Thus packaged, the first arrangement of fixed-temple eyewear 702 is complete and ready for packaging with other arrangements of fixed-temple eyewear.

Figure 8:
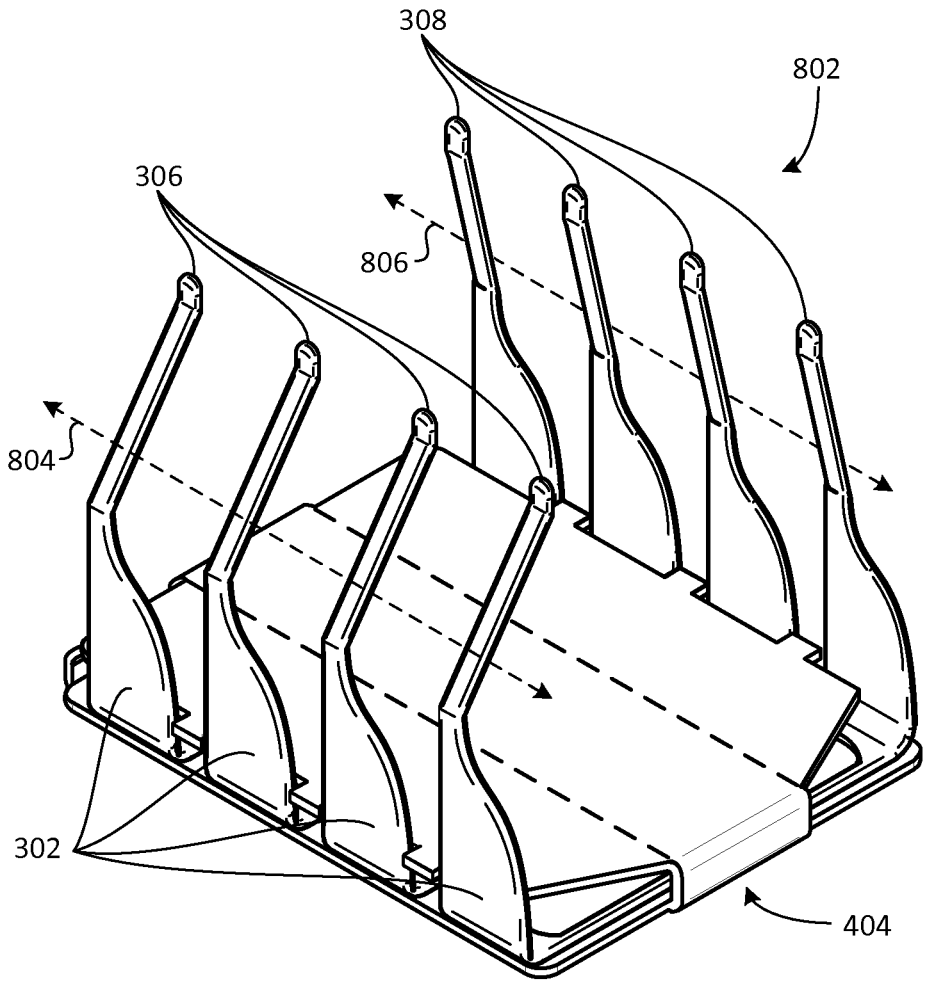
FIG. 8 is a perspective view of another plurality of fixed-temple eyewear fixed in another arrangement by another portion of the packaging material of FIG. 4.

FIG. 8 shows a second plurality (4) of fixed-temple eyewear 302 fixed in a second arrangement 802 by packaging material portion 404. Second arrangement 802 of eyewear 302 is similar to first arrangement 702, except for the obvious difference in the number of pairs of eyewear 302. In arrangement 802, the lenses of the eyewear 302 lie substantially in the same plane. The left temples 306 of eyewear 302 are aligned along a line 804, and the right temples 308 of eyewear 302 are aligned along another line 806.

Figure 9:
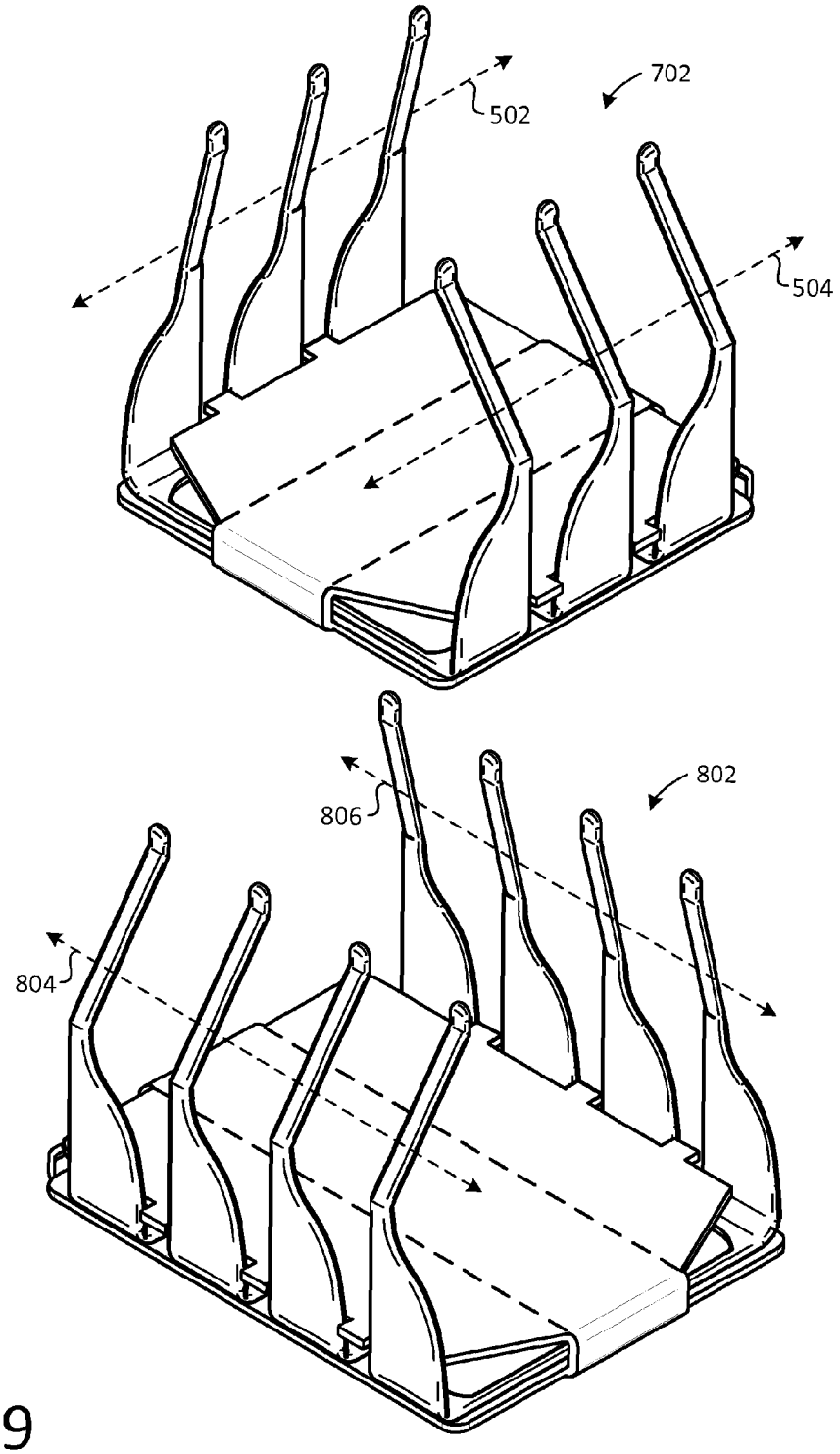
FIG. 9 is a perspective view of the arrangement of eyewear of FIG. 7 positioned relative to the arrangement of eyewear of FIG. 8.

FIG. 9 shows arrangement 702 of eyewear 302 oriented with respect to arrangement 802 of eyewear 302. Specifically, alignment lines 502 and 504 of arrangement 702 are oriented substantially perpendicular to alignment lines 804 and 806 of arrangement 802. In addition, the lenses of the eyewear 302 of arrangement 702 are aligned in one plane, and the lenses of the eyewear 302 of the second arrangement 802 are aligned in another plane. The two planes that the lenses are aligned in are substantially parallel to one another.

Figure 10:
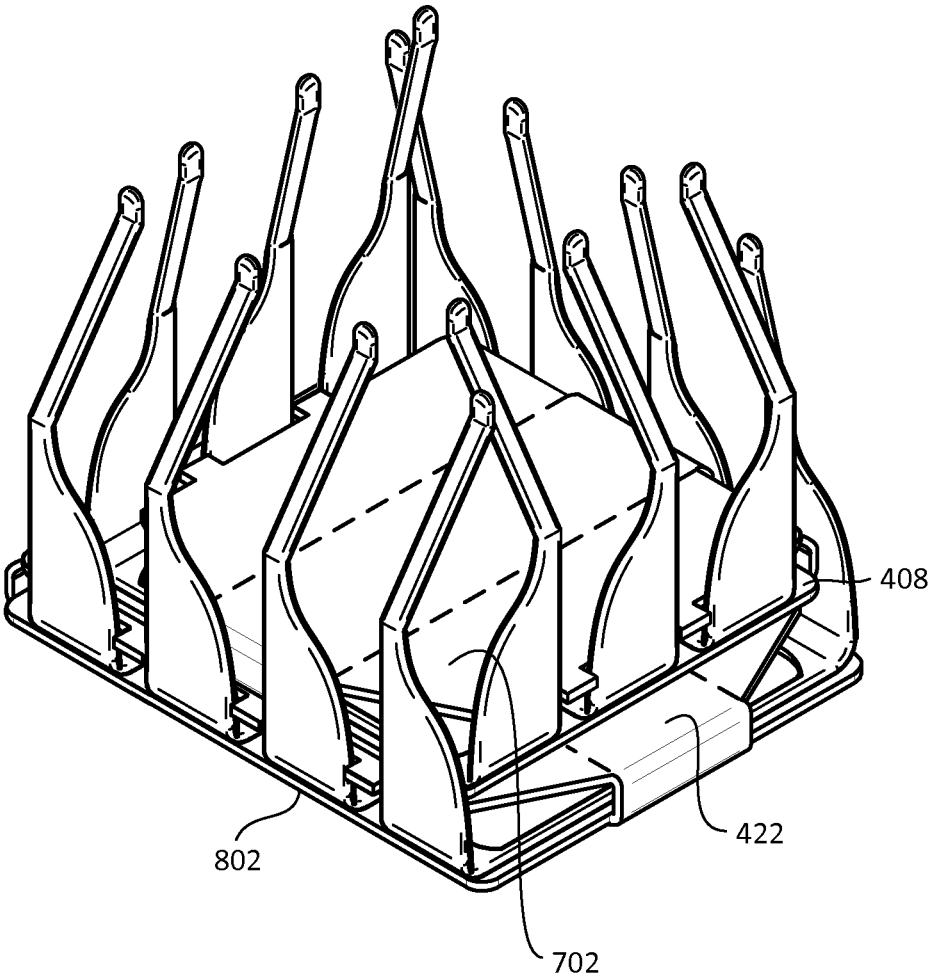
FIG. 10 is a perspective view of the arrangement of eyewear of FIG. 7 engaged with the arrangement of eyewear of FIG. 8.

FIG. 10 shows arrangement 702 of eyewear 302 engaged with arrangement 802 of eyewear 302. In particular, the arrangements 702 and 802 of eyewear 302 are oriented as shown in FIG. 9, but the arrangement 702 is disposed within the temples of the eyewear 302 of arrangement 802, in a nested relationship. In this particular example, the first section 408 of packaging material 402 rests directly on top of second section 422 of packaging material 404.

Figure 11:
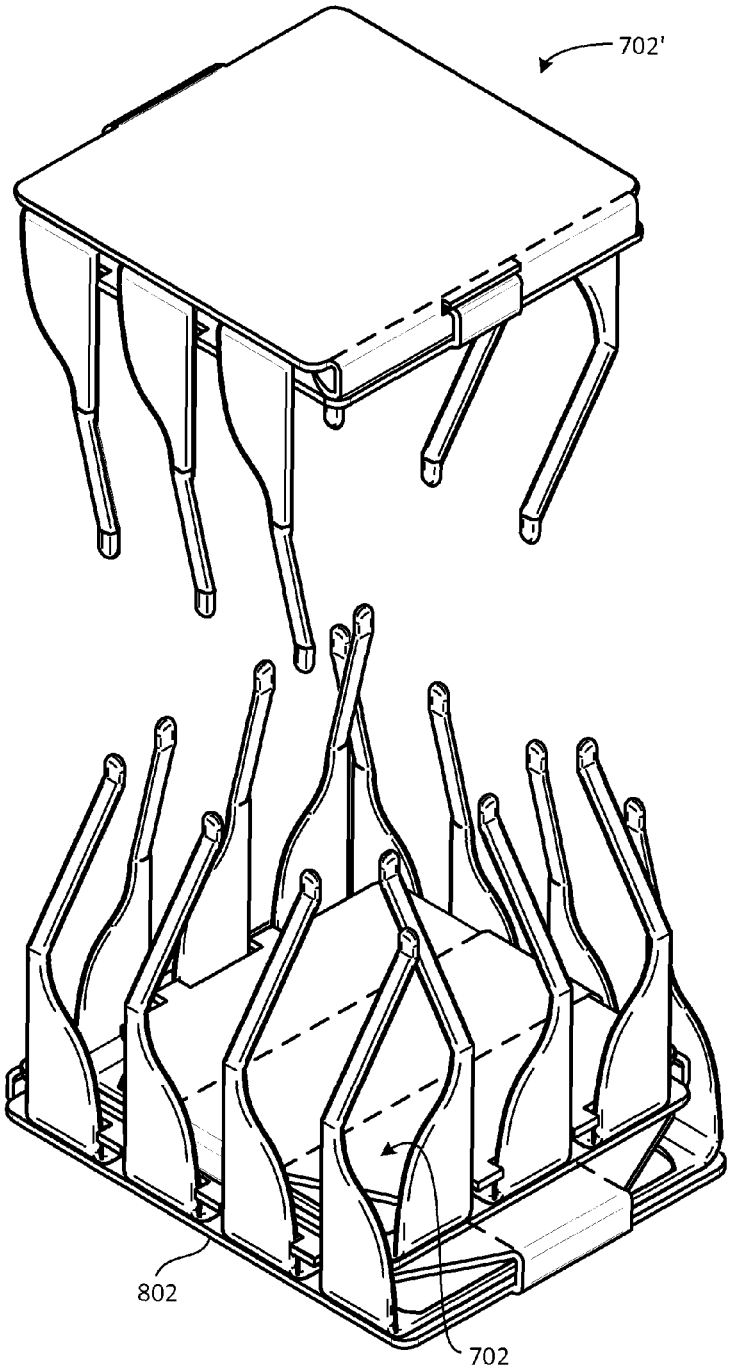
FIG. 11 is a perspective view of a third arrangement of eyewear positioned relative to the engaged arrangements of FIG. 10.

FIG. 11 shows a second iteration 702' of eyewear arrangement 702 oriented with respect to the engaged arrangements 702 and 802. Arrangement 702' is inverted and rotated 90 degrees with respect to eyewear arrangement 702. In this orientation, eyewear arrangement 702' is ready to engage eyewear arrangements 702 and 802.

Figure 12:
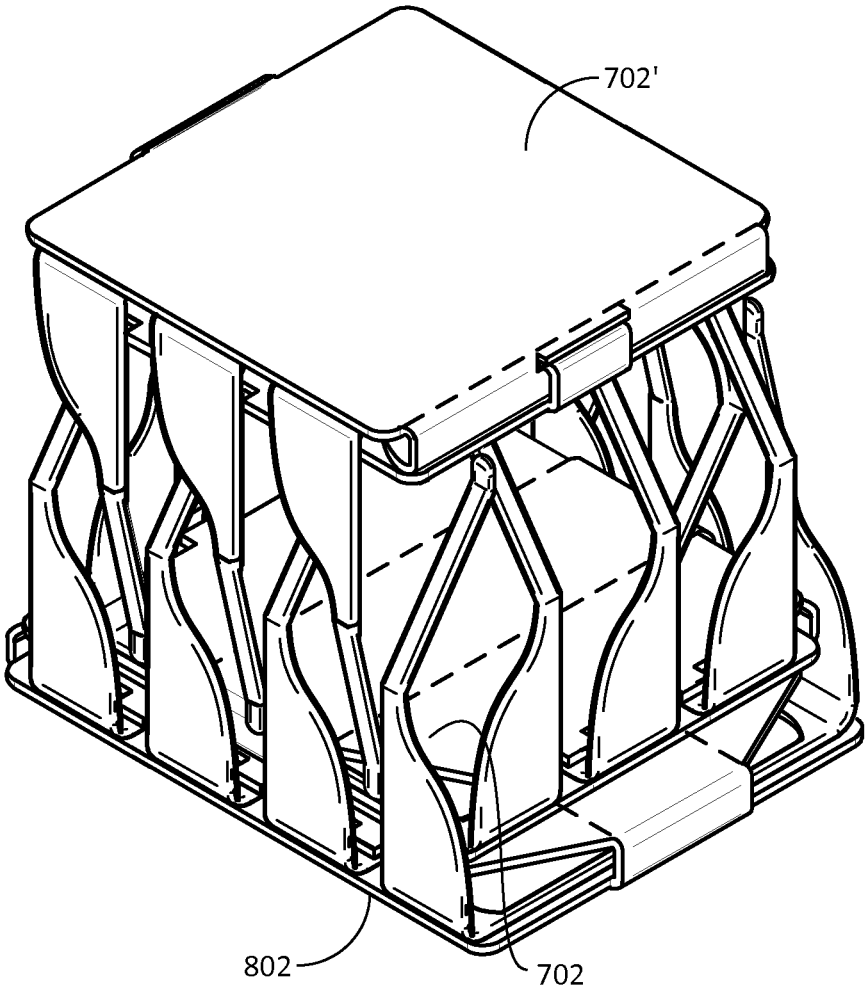
FIG. 12 is a perspective view of the third arrangement of eyewear of FIG. 11 engaged with the engaged arrangements of FIG. 10.

FIG. 12 shows eyewear arrangement 702' engaged with eyewear arrangements 702 and 802. In particular, eyewear arrangement 702' is lowered into position with the temples of the eyewear of arrangement 702' interleaved between the temples of the eyewear of arrangement 802.

Figure 13:
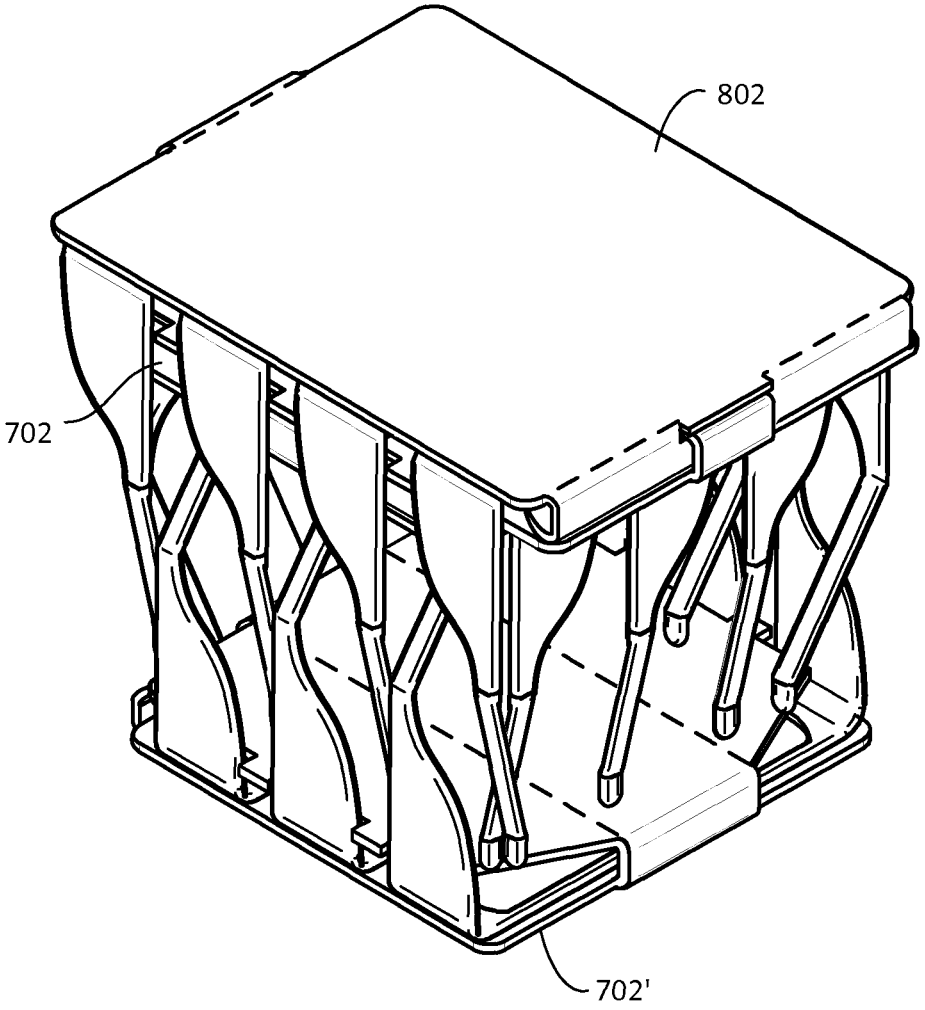
FIG. 13 is a perspective view of the engaged arrangements of eyewear of FIG. 12 in an inverted position.

FIG. 13 shows the three engaged arrangements of eyewear 702, 702' and 802 inverted vertically with respect to the orientation shown in FIG. 12. In this position, the three engaged arrangements of eyewear 702, 702' and 802 are now ready to be boxed together.

Figure 14:
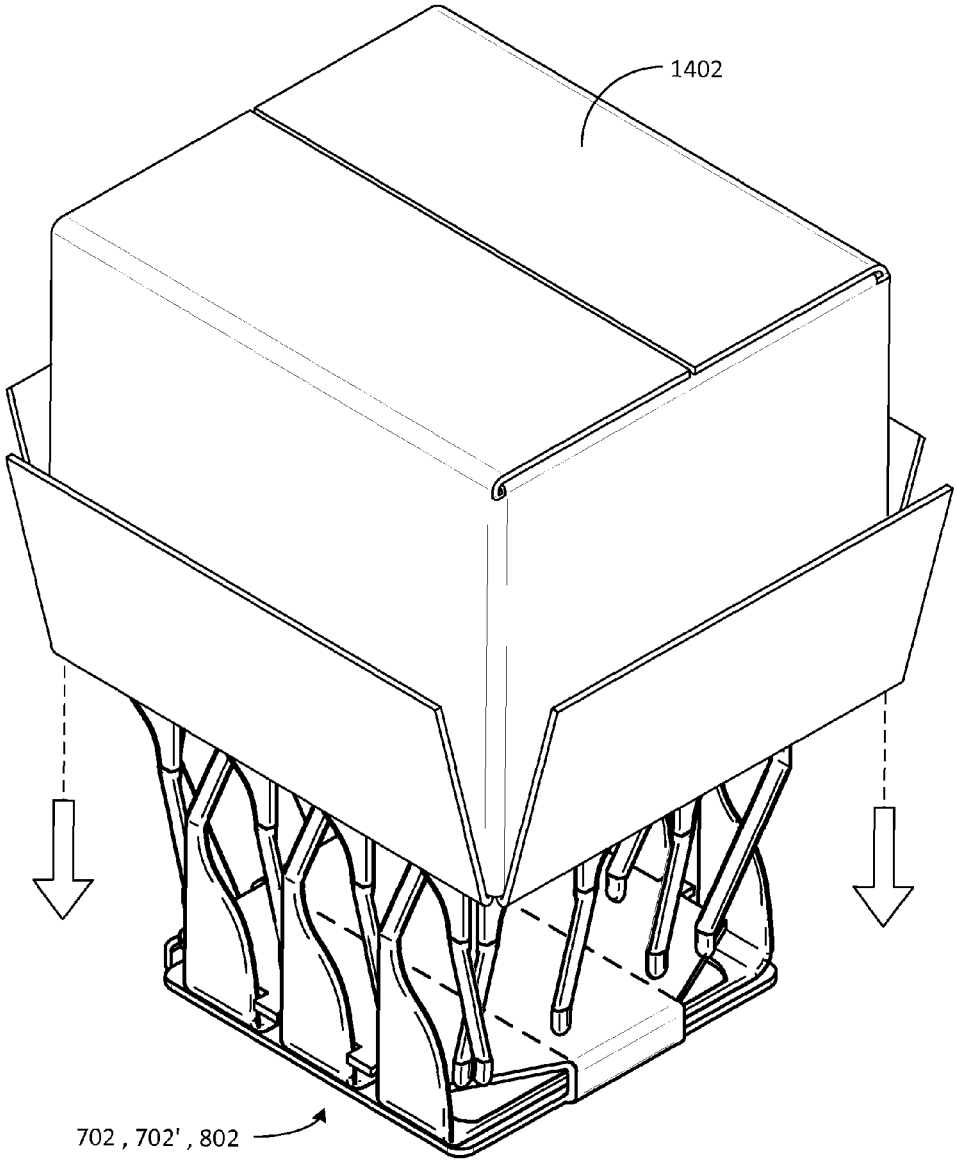
FIG. 14 is a perspective view of an inverted container being placed over the engaged arrangements of eyewear of FIG. 12.

FIG. 14 shows the inverted three engaged arrangements of eyewear 702, 702' and 802 of FIG. 13 with a substantially rectangular, parallelepiped container 1402 (e.g., a corrugated cardboard box) in an inverted position and being moved downward over the eyewear arrangements 702, 702' and 802.

Figure 15:
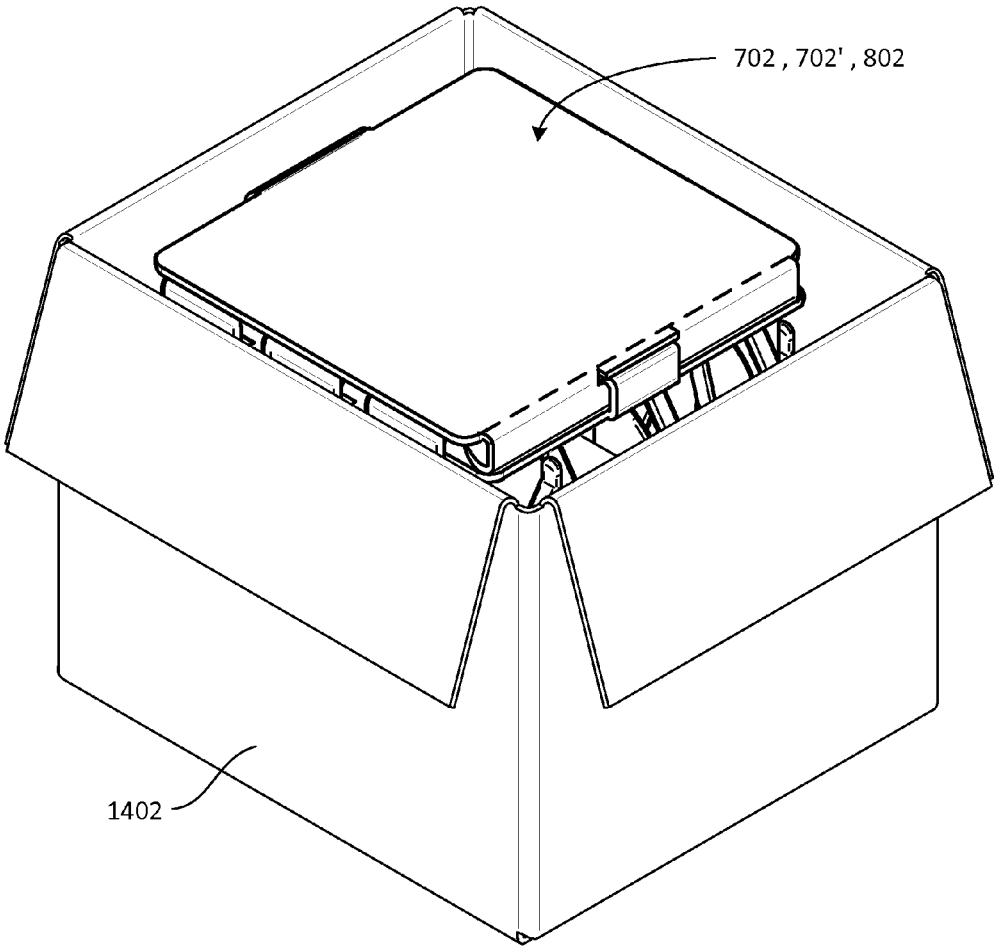
FIG. 15 is a perspective view of the container of FIG. 14 in an upright position with the engaged arrangements of eyewear inside.

FIG. 15 shows container 1402 and the three engaged arrangements of eyewear 702, 702' and 802, which have been inverted again to now be in the upright position. Arrangement of eyewear 702' (3 pairs of eyewear) is visible in the open top of container 1402. The opening of container 1402 is somewhat lager than eyewear arrangement 702', because container 1402 is sized just large enough to receive eyewear arrangement 802 (4 pairs of eyewear), which rests on the bottom of container 1402. Eyewear arrangements 702 and 802 are not visible in FIG. 15, except for a few distal tips of the temples of the eyewear of those arrangements. The packaging of eyewear arrangements 702, 702' and 802 is now substantially complete, except for closing and sealing the top of container 1402, which now contains 10 pairs of eyewear 302.

Figure 16:
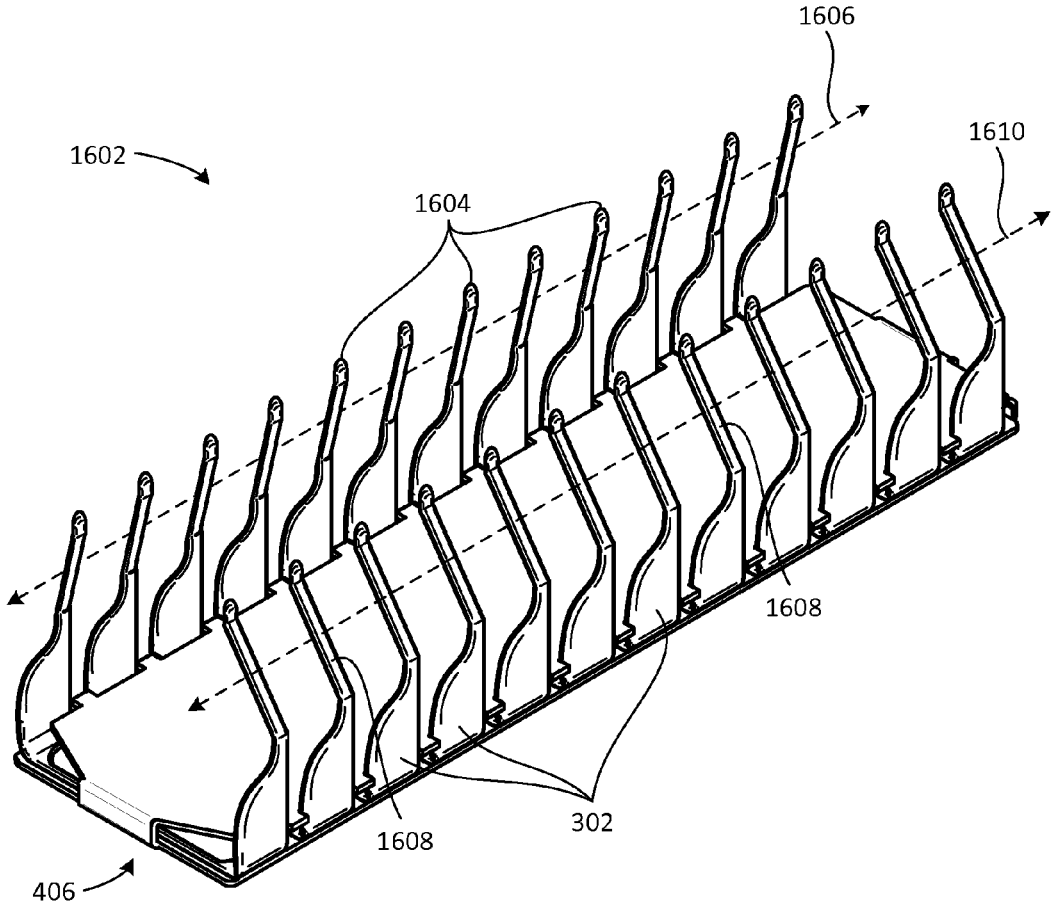
FIG. 16 is a perspective view of another plurality of pairs of fixed-temple eyewear fixed in another arrangement by another portion of packaging material of FIG. 4.

FIG. 16 shows a plurality (12 pairs) of eyewear 302 fixed in a third arrangement 1602 by packaging material portion 406. Third arrangement 1602 of eyewear 302 is similar to first arrangement 702 and second arrangement 802, except for the obvious difference in the number of pairs of eyewear 302. In arrangement 1602, the lenses of the eyewear 302 lie substantially in the same plane, the left temples 1604 are aligned along a first line 1606, and the right temples 1608 are aligned along a second line 1610.

Figure 17:
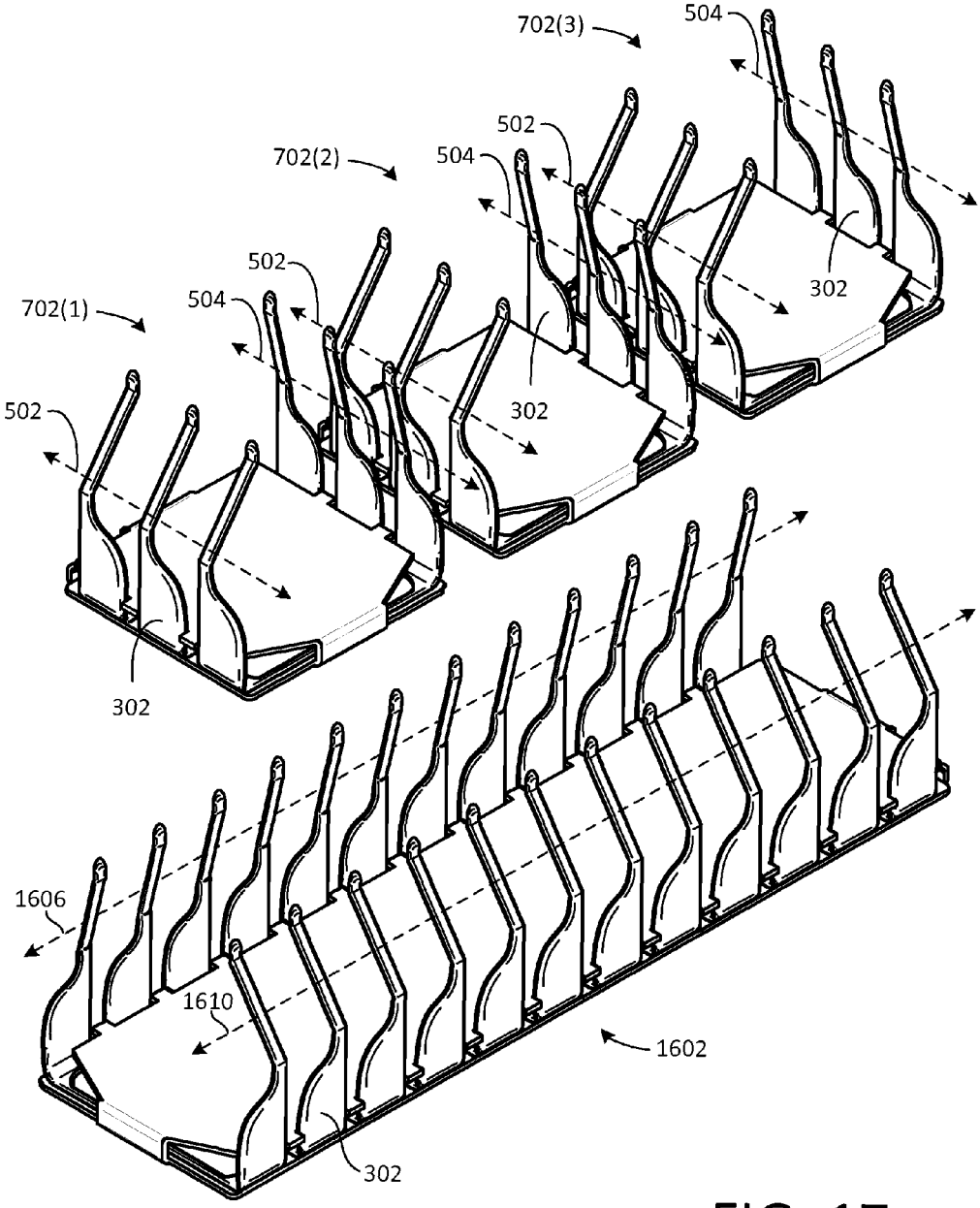
FIG. 17 is a perspective view of a plurality of iterations of the arrangement of eyewear of FIG. 7 positioned with respect to the arrangement of eyewear of FIG. 16.

FIG. 17 shows arrangements 702(1-3) of eyewear 302 oriented with respect to arrangement 1602 of eyewear 302. Specifically, alignment lines 502 and 504 of arrangements 702(1-3) are oriented substantially perpendicular to alignment lines 1606 and 1610 of arrangement 1602. In addition, the lenses of the eyewear 302 of arrangements 702(1-3) are aligned in one plane, and the lenses of the eyewear 302 of the second arrangement 1602 are aligned in another plane. The two planes that the lenses are aligned in are substantially parallel to one another.

Figure 18:
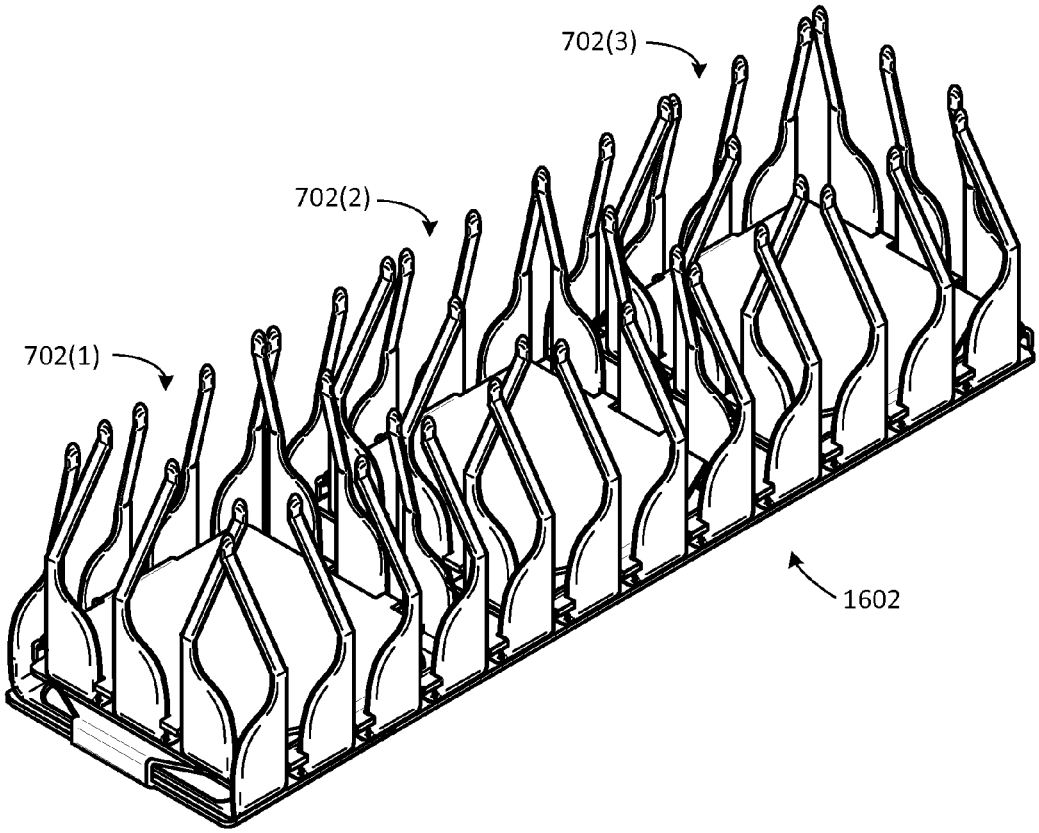
FIG. 18 is a perspective view of the plurality of iterations of the arrangement of eyewear of FIG. 7 engaged with the arrangement of eyewear of FIG. 16.

FIG. 18 shows arrangements 702(1-3) of eyewear 302 engaged with arrangement 1602 of eyewear 302. In particular, the arrangements 702(1-3) of eyewear 302 are oriented as shown in FIG. 17, but the arrangements 702(1-3) are disposed within the temples of the eyewear 302 of arrangement 1602, in a nested relationship. In this particular example, the first sections 408 of packaging material portions 402 (FIG. 4) rest directly on top of second section 422 of packaging material 404 (FIG. 4).

As indicated previously, packaging material that fixes numbers of eyewear that are integer multiples of four are preferred. FIG. 17 illustrates this principle. In particular, the dimensions of the eyewear in this example embodiment are such that the height of four pair of eyewear is required to accommodate the width of the three pair of eyewear nested therein. If the height and/or width of the eyewear changed, then this 3-in-4 nesting ratio might change.

Figure 19:
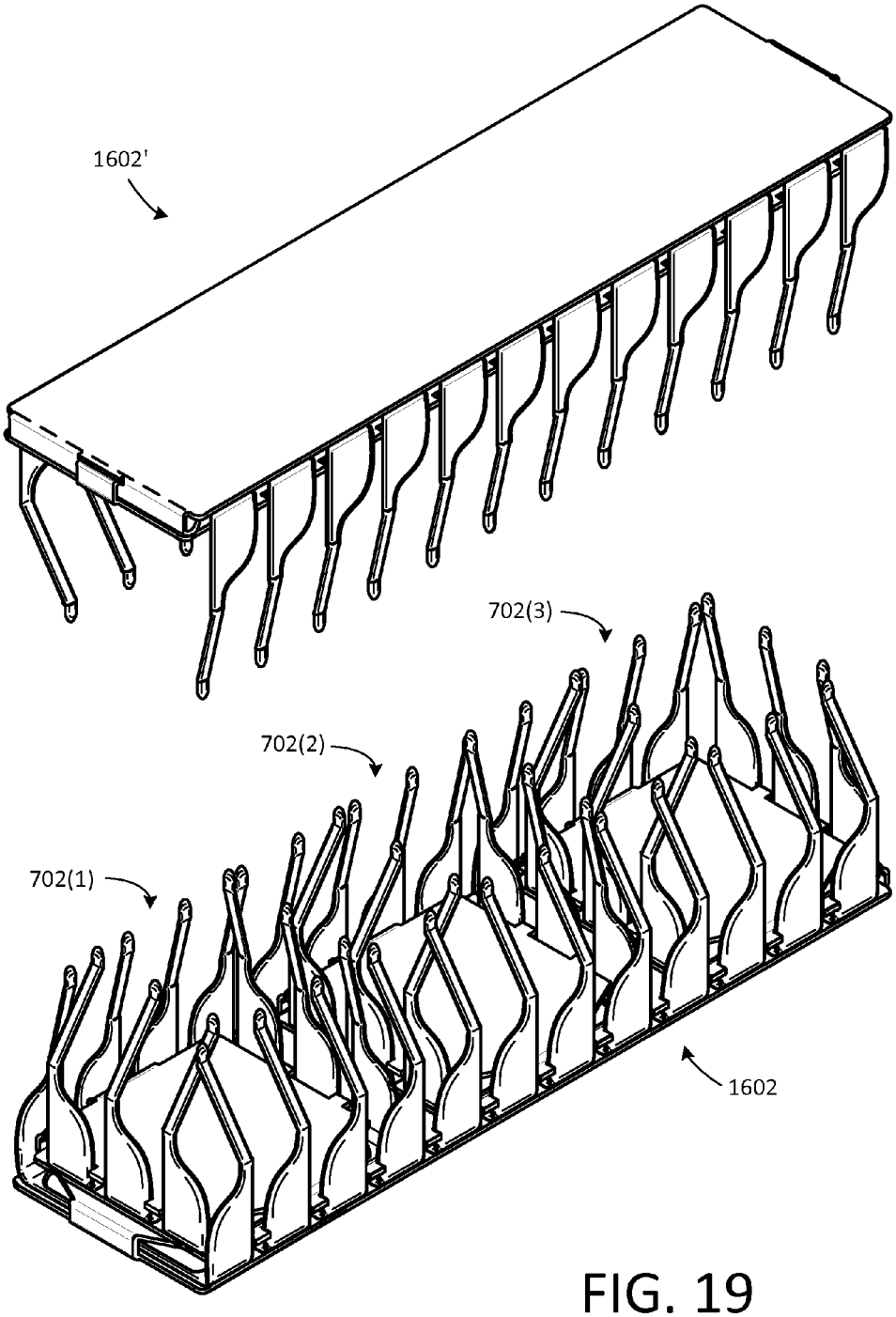
FIG. 19 is a perspective view of another iteration of the arrangement of eyewear of FIG. 16 positioned with respect to the engaged arrangements of eyewear of FIG. 18.

FIG. 19 shows a second iteration 1602' of eyewear arrangement 1602 oriented with respect to the engaged arrangements 702(1-3) and 1602. Arrangement 1602' is inverted and rotated 180 degrees with respect to eyewear arrangement 1602. In this orientation, eyewear arrangement 1602' is ready to engage eyewear arrangements 702(1-3) and 1602.

Figure 20:
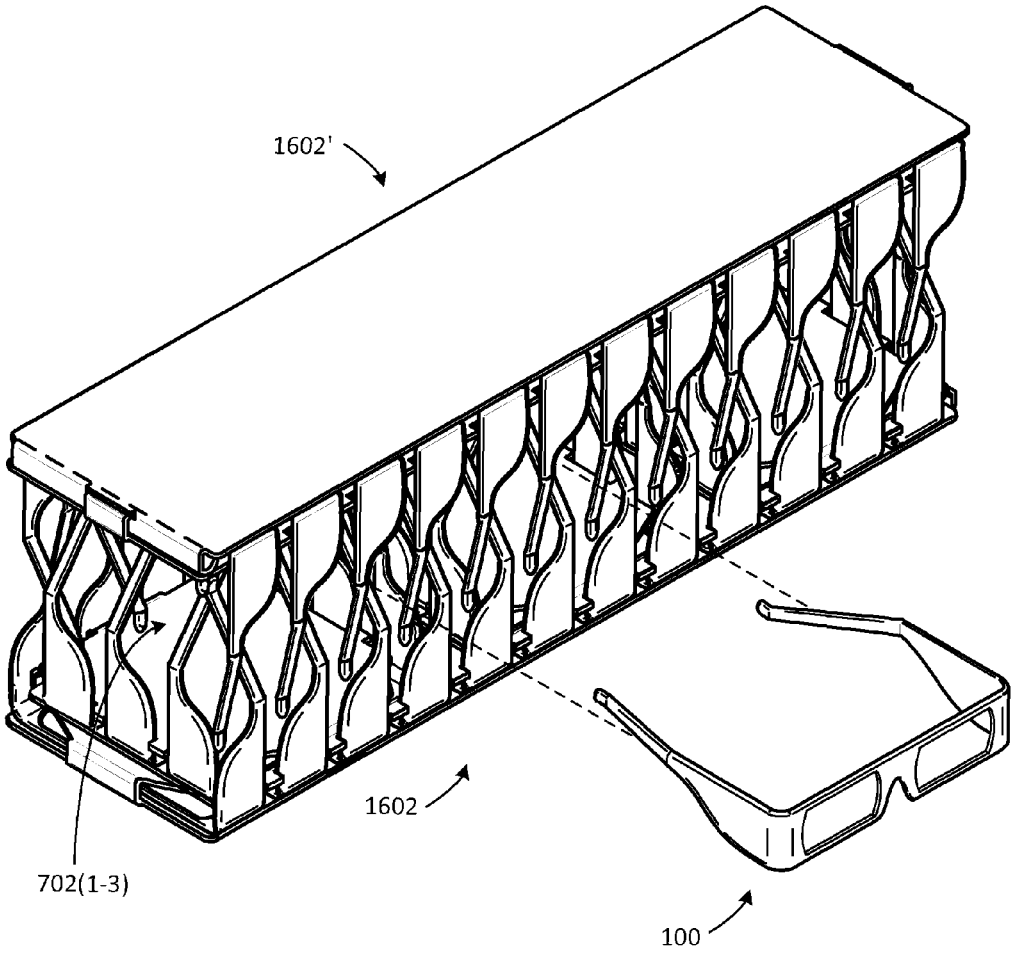
FIG. 20 is a perspective view of arrangements of eyewear of FIG. 18 engaged with one another.

FIG. 20 shows eyewear arrangement 1602' engaged with eyewear arrangements 702(1-3) and 1602. In particular, eyewear arrangement 1602' is lowered into position with the temples of the eyewear of arrangement 1602' interleaved between the temples of the eyewear of arrangement 1602.

The engaged arrangements of eyewear 1602, 702(1-3), and 1602' fix 33 pairs of eyewear 302 that are ready to be placed in a shipping carton. The placement of arrangements 1602, 702(1-3), and 1602' is not significantly different than the previously described process of placing arrangements 702, 802, and 702' in a rectangular, parallelepiped container. Therefore, the process of placing eyewear arrangements 1602, 702(1-3), and 1602' in a container will not be described in detail. However, it should be understood that more than one iteration of the engaged eyewear arrangements can be placed in a single container. For example, 3 iterations of engaged arrangements 1602, 702(1-3), and 1602' can be placed in a single, suitably sized container, which results in 99 pairs of eyewear 302 in a single carton.

Optionally, dividers (e.g., planar cardboard sections) can be placed in the container between the adjacent iterations of the engaged eyewear arrangements to prevent rubbing between the eyewear of adjacent arrangements. As another option, individual pairs of eyewear 302 can be loosely placed within the enclosed space defined by the temples of the eyewear 302. As another option, loose pairs of eyewear 302 can be engaged with the previously engaged arrangements 1602, 702(1-3), and 1602', by inserting the temples of the individual pairs of eyewear 302 between the temples of arrangements 1602 and 1602', as shown in FIG. 20.

Figure 21:
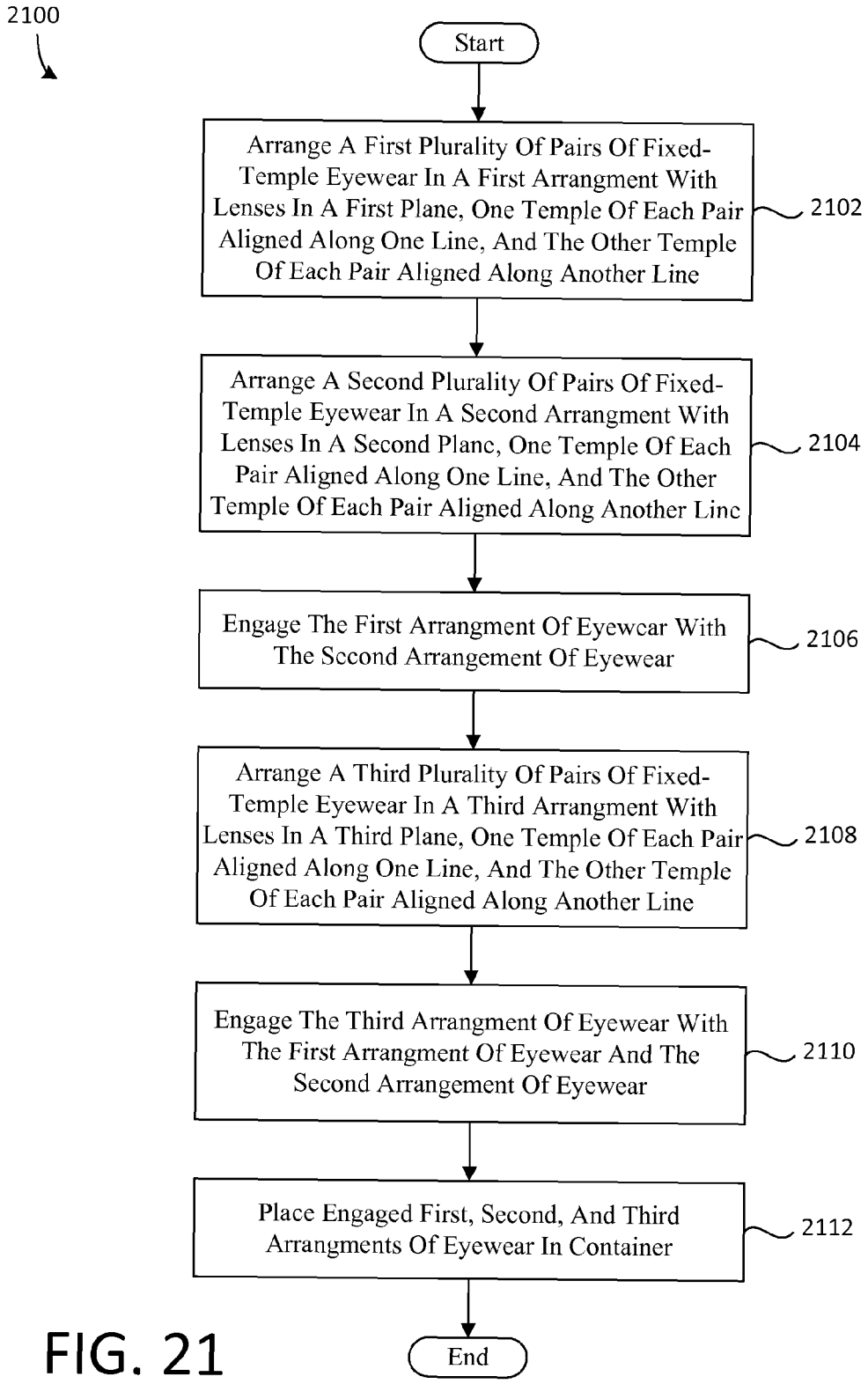
FIG. 21 is a flowchart summarizing an example method of packaging fixed-temple eyewear according to one aspect of the present invention.

FIG. 21 is a flowchart summarizing an example method 2100 of packaging eyewear according to one aspect of the present invention. In a first step 2102, a first plurality of fixed-temple eyewear are fixed in a first arrangement with their lenses in a first plane, one temple of each pair aligned along one line, and the other temple of each pair aligned along another line. Then, in a second step 2104, a second plurality of fixed-temple eyewear are fixed in a second arrangement with their lenses in a second plane, one temple of each pair aligned along one line, and the other temple of each pair aligned along another line. Next, in a third step 2106, the first arrangement of eyewear is engaged with the second arrangement of eyewear. Then, in a fourth step 2108, a third plurality of fixed-temple eyewear are fixed in a third arrangement with their lenses in a third plane, one temple of each pair aligned along one line, and the other temple of each pair aligned along another line. Next, in a fifth step 2110, the third arrangement of eyewear is engaged with the first arrangement of eyewear and the second arrangement of eyewear. Then, in a sixth step 2112. The first, second, and third engaged arrangements of eyewear are placed in a container.

Figure 22:
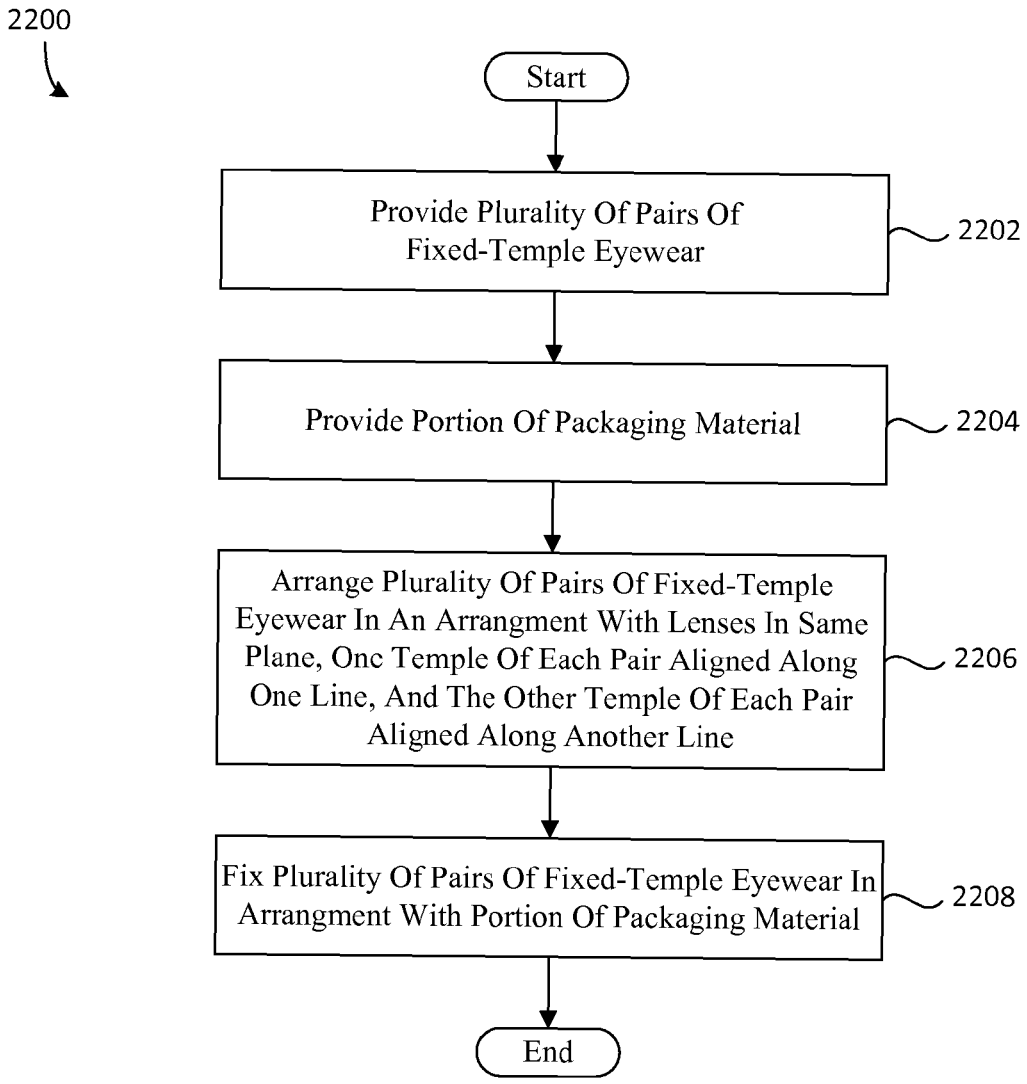
FIG. 22 is a flowchart summarizing an example method of performing the first, second, or fourth step of the method of FIG. 21.

FIG. 22 is a flowchart 2200 summarizing an example method of performing first step 2102, second step 2104, or fourth step 2108 of method 2100 of FIG. 21. In a first step 2202, a plurality of pairs of fixed temple eyewear is provided. Then, in a second step 2204, a portion of packaging material is provided. Next, in a third step 2206, the plurality of pairs of fixed-temple eyewear are arranged in an arrangement with their lenses in a same plane, one temple of each pair aligned along one line, and the other temple of each pair aligned along another line. Then, in a fourth step 2208, the plurality of pairs of fixed-temple eyewear is fixed in the arrangement with a portion of packaging material.

The description of particular embodiments of the present invention is now complete. Many of the described features may be substituted, altered or omitted without departing from the scope of the invention. For example, arrangements of different sizes of fixed-temple eyewear (e.g., adult and child sizes) can be engaged with one another. As another example, different numbers of pairs of fixed-temple eyewear can be included in arrangements to efficiently use the available space in a shipping container. In addition, aspects of the present invention can be used with eyewear having hinged temples. These and other deviations from the particular embodiments shown will be apparent to those skilled in the art, particularly in view of the foregoing disclosure.

I claim:

1. A method for packaging fixed-temple eyewear each having two lenses and two temple pieces fixed in position with respect to said lenses, said method including:

providing a first plurality of pairs of said fixed-temple eyewear;

providing a first portion of packaging material;

arranging said first plurality of pairs of fixed-temple eyewear in a first arrangement wherein said lenses lie substantially in a same plane, a first one of said temples of each of said pairs of fixed-temple eyewear of said first plurality of fixed-temple eyewear are aligned along a first line, and a second one of said temples of each of said pairs of fixed-temple eye-wear of said first plurality of fixed temple eyewear are aligned along a second line; and fixing said plurality of pairs of fixed-temple eyewear in said arrangement with said portion of said packaging material;

the method further comprising:

providing a second plurality of pairs of said fixed-temple eyewear;

providing a second portion of packaging material;

arranging said second plurality of pairs of fixed-temple eyewear in a second arrangement wherein said lenses lie substantially in a same plane, a first one of said temples of each of said pairs of fixed-temple eyewear of said second plurality of fixed temple eyewear are aligned along a first line, and a second one of said temples of each of said pairs of fixed-temple eye-wear of said second plurality of fixed-temple eyewear are aligned along a second line;

fixing said second plurality of pairs of fixed-temple eyewear in said second arrangement with said second portion of said packaging material; and engaging said first arrangement of said plurality of pairs of said fixed-temple eyewear with said second arrangement of said second plurality of pairs of said fixed-temple eyewear;

the method yet further comprising:

providing a third plurality of pairs of said fixed-temple eyewear;

providing a third portion of packaging material;

arranging said third plurality of pairs of fixed-temple eyewear in a third arrangement wherein said lenses lie substantially in a same plane, a first one of said temples of each of said pairs of fixed-temple eyewear of said third plurality of said fixed-temple eyewear are aligned along a first line, and a second one of said temples of each of said pairs of fixed-temple eye-wear of said third plurality of said fixed-temple eyewear are aligned along a second line;

fixing said third plurality of pairs of fixed-temple eyewear in said third arrangement with said third portion of said packaging material; and engaging said third arrangement of said third plurality of pairs of fixed-temple eyewear with said first arrangement of said first plurality of pairs of said fixed-temple eyewear and said second arrangement of said second plurality of pairs of said fixed-temple eyewear to form an assembly of said fixed-temple eyewear; and wherein said step of engaging said first arrangement of said first plurality of pairs of said fixed-temple eyewear with said second arrangement of said second plurality of pairs of said fixed-temple eyewear includes:

positioning said second arrangement of said second plurality of pairs of said fixed-temple eyewear within the temples of said first plurality of pairs of fixed-temple eyewear of said first arrangement of said first plurality of pairs of fixed-temple eyewear;

orienting said second arrangement of said second plurality of fixed-temple eyewear with said first line of said second arrangement being substantially perpendicular to said first line of said first arrangement; and positioning said second portion of packaging material on said first portion of packaging material.

2. The method of claim 1, wherein said step of engaging said third arrangement of said third plurality of pairs of fixed-temple eyewear with said first arrangement of said first plurality of pairs of said fixed-temple eyewear and said second arrangement of said second plurality of pairs of said fixed-temple eyewear includes:

positioning said third arrangement of said third plurality of pairs of said fixed-temple eyewear with said first line of said third arrangement substantially parallel to said first line of said first arrangement and substantially perpendicular to said first line of said second arrangement, said temples of said third plurality of eyewear extending in a direction opposite to said temples of said first plurality of eyewear and said temples of said second plurality of eyewear; and interleaving said temples of said eyewear of said third arrangement with said temples of said eyewear of said first arrangement.

3. The method of claim 2, further comprising placing said first arrangement of said first plurality of pairs of said fixed temple eye-wear, said second arrangement of said second plurality of pairs of said fixed temple eye-wear, and said third arrangement of said third plurality of pairs of said fixed temple eye-wear in a substantially rectangular parallelepiped container.

4. The method of claim 3, wherein said step of placing said first arrangement, said second arrangement, and said third arrangement in said container occurs after said step of engaging said third arrangement of said third plurality of pairs of fixed-temple eyewear with said first arrangement of said first plurality of pairs of said fixed-temple eyewear and said second arrangement of said second plurality of pairs of said fixed-temple eyewear.

5. The method of claim 1, further comprising:

positioning additional iterations of said second arrangement of said second plurality of pairs of fixed-temple eyewear within the temples of said first plurality of pairs of said fixed-temple eyewear of said first arrangement of said first plurality of pairs of fixed-temple eyewear;

orienting said additional iterations of said second arrangement of said second plurality of fixed-temple eyewear with said first line of said additional iterations of second arrangement being substantially perpendicular to said first line of said first arrangement; and positioning said second portions of packaging material of said additional iterations of said second arrangement on said first portion of packaging material of said first arrangement.

6. The method according to claim 5, wherein the step of engaging comprises engaging the sets of eyewear at 90 degrees relative to each other.

7. The method according to claim 5, wherein the step of engaging comprises placing one set of eyewear inside the temples of the other set of eyewear.

8. The method according to claim 5, wherein the step of engaging comprises placing an outside surface of lenses of one set of eyewear adjacent to an inside surface of the other set of eyewear separated by a layer of material.

9. The method according to claim 5, wherein the step of engaging comprising fitting one set of eyewear inside another set of eyewear such that the one set of eyewear is held within the other set of eyewear at least partially by the temples of the one set of eyewear.

10. The method according to claim 5, wherein said fixed temple eyewear comprises 3D glasses.

11. The method according to claim 10, wherein a package so loaded has a density of 50 or more pairs of 3D glasses per cubic foot.

12. The method according to claim 5, further comprising the step of repeating the steps of the method to form additional assemblies of the fixed-temple eyewear and placing a plurality of the assemblies in a single container.

13. The method according to claim 12, wherein the single container has a density of 40 or more pairs of fixed temple eyewear per cubic foot.

14. The method according to claim 13, wherein the container comprises a rectangular parallelepiped container.

15. The method according to claim 1, wherein the step of engaging comprises engaging the sets of eyewear at 90 degrees relative to each other.

16. The method according to claim 1, wherein the step of engaging comprises placing one set of eyewear inside the temples of the other set of eyewear.

17. The method according to claim 1, wherein the step of engaging comprises placing an outside surface of lenses of one set of eyewear adjacent to an inside surface of the other set of eyewear separated by a layer of material.

18. The method according to claim 1, wherein the step of engaging comprising fitting one set of eyewear inside another set of eyewear such that the one set of eyewear is held within the other set of eyewear at least partially by the temples of the one set of eyewear.

19. The method according to claim 1, wherein said fixed temple eyewear comprises 3D glasses.

20. A package loaded according to claim 19 having a density of 50 or more pairs of 3D glasses per cubic foot.

21. The method according to claim 19, further comprising the step of repeating the steps of the method to form additional assemblies of the fixed-temple eyewear and placing a plurality of the assemblies in a single container.

22. The method according to claim 21, wherein the single container has a density of 40 or more pairs of fixed temple eyewear per cubic foot.

23. The method according to claim 22, wherein the container comprises a rectangular parallelepiped container.

* * * * *